US007911416B2

(12) United States Patent
Woo et al.

(10) Patent No.: US 7,911,416 B2
(45) Date of Patent: Mar. 22, 2011

(54) PLASMA DISPLAY PANEL

(75) Inventors: Seok-Gyun Woo, Asan-si (KR); Woo-Tae Kim, Yongin-si (KR); Kyoung-Doo Kang, Seoul (KR); Hun-Suk Yoo, Cheonan-si (KR); Jae-Ik Kwon, Asan-si (KR); Tae-Joung Kweon, Suwon-si (KR); Eun-Gi Heo, Cheonan-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 751 days.

(21) Appl. No.: 11/952,075

(22) Filed: Dec. 6, 2007

(65) Prior Publication Data

US 2008/0094319 A1 Apr. 24, 2008

Related U.S. Application Data

(62) Division of application No. 10/867,857, filed on Jun. 14, 2004, now Pat. No. 7,327,083.

(30) Foreign Application Priority Data

| | | |
|---|---|---|
| Jun. 25, 2003 | (KR) | 2003-0041491 |
| Jul. 3, 2003 | (KR) | 2003-0044861 |
| Jul. 22, 2003 | (KR) | 2003-0050278 |
| Jul. 30, 2003 | (KR) | 2003-0052598 |
| Aug. 1, 2003 | (KR) | 2003-0053461 |
| Oct. 21, 2003 | (KR) | 2003-0073518 |
| Oct. 21, 2003 | (KR) | 2003-0073519 |

(51) Int. Cl.
*G09G 3/28* (2006.01)

(52) U.S. Cl. ..... 345/60; 313/582; 315/169.4

(58) Field of Classification Search ..... 345/37, 345/42, 47–48, 60–68; 315/169.4; 313/582–587
See application file for complete search history.

(56) References Cited

U.S. PATENT DOCUMENTS 5,640,068 A 6/1997 Amemiya (Continued)

FOREIGN PATENT DOCUMENTS

CN 1154528 A 7/1997

(Continued)

OTHER PUBLICATIONS

U.S. Office action dated Jan. 28, 2009, for related U.S. Appl. No. 10/929,626, indicating relevance of listed references in this IDS.

(Continued)

*Primary Examiner* — Quan-Zhen Wang
*Assistant Examiner* — Mansour M Said
(74) *Attorney, Agent, or Firm* — Christie, Parker & Hale, LLP

(57) ABSTRACT

A plasma display panel. A first substrate and a second substrate are provided opposing one another with a predetermined gap therebetween. Address electrodes are formed on the second substrate. Barrier ribs are mounted between the first substrate and the second substrate, the barrier ribs defining a plurality of discharge cells and a plurality of non-discharge regions. Phosphor layers are formed within each of the discharge cells. Discharge sustain electrodes are formed on the first substrate. The non-discharge regions are formed in areas encompassed by discharge cell abscissas and ordinates that pass through centers of each of the discharge cells. Also, external light absorbing members are formed between the second substrate and the barrier ribs layer at areas corresponding to locations of the non-discharge regions.

17 Claims, 20 Drawing Sheets

U.S. PATENT DOCUMENTS

| | | | | |
|---|---|---|---|---|
| 5,661,500 | A | 8/1997 | Shinoda et al. | |
| 5,952,782 | A | 9/1999 | Nanto et al. | |
| 6,031,329 | A | 2/2000 | Nagano | |
| 6,200,182 | B1 | 3/2001 | Nanto et al. | |
| 6,249,264 | B1 * | 6/2001 | Sano et al. | 345/60 |
| 6,288,488 | B1 | 9/2001 | Amemiya | |
| 6,342,874 | B1 | 1/2002 | Tokunaga et al. | |
| 6,373,195 | B1 | 4/2002 | Whang et al. | |
| 6,376,986 | B1 | 4/2002 | Takagi et al. | |
| 6,424,095 | B1 | 7/2002 | Hirao et al. | |
| 6,479,932 | B1 | 11/2002 | Nunomura | |
| 6,495,957 | B2 | 12/2002 | Kurogi et al. | |
| 6,498,593 | B1 | 12/2002 | Fujimoto et al. | |
| 6,504,519 | B1 | 1/2003 | Ryu et al. | |
| 6,522,072 | B1 | 2/2003 | Yura et al. | |
| 6,534,914 | B2 | 3/2003 | Amemiya et al. | |
| 6,577,061 | B2 | 6/2003 | Sano et al. | |
| 6,603,263 | B1 | 8/2003 | Hashimoto et al. | |
| 6,608,441 | B2 | 8/2003 | Kunii et al. | |
| 6,630,788 | B1 * | 10/2003 | Park | 313/582 |
| 6,639,363 | B2 | 10/2003 | Amatsuchi et al. | |
| 6,646,377 | B2 * | 11/2003 | Hashimoto | 313/582 |
| 6,657,386 | B2 | 12/2003 | Koshio et al. | |
| 6,670,754 | B1 | 12/2003 | Murai et al. | |
| 6,674,238 | B2 | 1/2004 | Otani et al. | |
| 6,700,323 | B2 | 3/2004 | Amemiya | |
| 6,703,772 | B2 | 3/2004 | Hasegawa et al. | |
| 6,707,259 | B2 * | 3/2004 | Nagao et al. | 315/169.4 |
| 6,727,869 | B1 | 4/2004 | Kosaka | |
| 6,774,558 | B2 | 8/2004 | Otani et al. | |
| 6,819,046 | B2 | 11/2004 | Hirano | |
| 6,838,828 | B2 | 1/2005 | Joo et al. | |
| 6,853,136 | B2 | 2/2005 | Kim et al. | |
| 6,870,314 | B2 | 3/2005 | Kifune et al. | |
| 6,946,785 | B2 | 9/2005 | Ito et al. | |
| 6,982,525 | B2 * | 1/2006 | Mun et al. | 313/582 |
| 7,012,370 | B2 | 3/2006 | Kanazawa et al. | |
| 7,088,314 | B2 | 8/2006 | Harada et al. | |
| 7,136,033 | B2 | 11/2006 | Kim et al. | |
| 7,166,960 | B2 | 1/2007 | Kim et al. | |
| 7,208,875 | B2 | 4/2007 | Kwon et al. | |
| 7,230,379 | B2 | 6/2007 | Kwon et al. | |
| 7,365,712 | B2 | 4/2008 | Yi | |
| 2002/0000779 | A1 | 1/2002 | Anders | |
| 2002/0021090 | A1 | 2/2002 | Sano et al. | |
| 2002/0047519 | A1 | 4/2002 | Kunii et al. | |
| 2002/0063510 | A1 | 5/2002 | Yura et al. | |
| 2002/0063523 | A1 | 5/2002 | Amatsuchi et al. | |
| 2003/0080682 | A1 | 5/2003 | Nagano | |
| 2003/0193487 | A1 | 10/2003 | Yatsuda et al. | |
| 2004/0051457 | A1 | 3/2004 | Kimura et al. | |
| 2004/0085264 | A1 | 5/2004 | Takada et al. | |
| 2004/0113555 | A1 | 6/2004 | Han et al. | |
| 2004/0234902 | A1 | 11/2004 | Toyoda et al. | |
| 2004/0256989 | A1 | 12/2004 | Kim et al. | |
| 2004/0263078 | A1 | 12/2004 | Woo et al. | |
| 2005/0001551 | A1 | 1/2005 | Kim et al. | |
| 2005/0017637 | A1 | 1/2005 | Kang et al. | |
| 2005/0029939 | A1 | 2/2005 | Woo et al. | |
| 2005/0052137 | A1 | 3/2005 | Kwon et al. | |
| 2005/0088094 | A1 | 4/2005 | Kim et al. | |
| 2005/0134176 | A1 | 6/2005 | Kwon et al. | |
| 2005/0212430 | A1 | 9/2005 | Ahn et al. | |
| 2006/0164335 | A1 | 7/2006 | Woo et al. | |
| 2007/0114933 | A1 | 5/2007 | Kim et al. | |

FOREIGN PATENT DOCUMENTS

| | | | |
|---|---|---|---|
| CN | 1264914 | | 8/2000 |
| CN | 1267877 | | 9/2000 |
| CN | 1327253 | | 12/2001 |
| CN | 1337665 | | 2/2002 |
| CN | 1344005 | | 4/2002 |
| CN | 1397976 | | 2/2003 |
| EP | 0 920 048 | A2 | 6/1999 |
| EP | 1 263 014 | A1 | 12/2002 |
| JP | 4-298936 | | 10/1992 |
| JP | 5-94772 | | 4/1993 |
| JP | 6-44907 | | 2/1994 |
| JP | 6-342631 | | 12/1994 |
| JP | 7-65728 | | 3/1995 |
| JP | 10-149771 | | 6/1998 |
| JP | 10-269951 | | 10/1998 |
| JP | 10-283934 | | 10/1998 |
| JP | 10-308179 | | 11/1998 |
| JP | 10-334811 | | 12/1998 |
| JP | 11-31460 | | 2/1999 |
| JP | 11-067099 | | 3/1999 |
| JP | 11-96921 | | 4/1999 |
| JP | 11-213893 | | 8/1999 |
| JP | 11-213903 | | 8/1999 |
| JP | 11-317170 | | 11/1999 |
| JP | 11-327498 | | 11/1999 |
| JP | 11-345570 | | 12/1999 |
| JP | 2000-11899 | | 1/2000 |
| JP | 2000-21313 | | 1/2000 |
| JP | 2000-42661 | | 2/2000 |
| JP | 2000-82407 | | 3/2000 |
| JP | 2000-113828 | | 4/2000 |
| JP | 2000-187200 | | 7/2000 |
| JP | 2000-195431 | | 7/2000 |
| JP | 2000-228150 | | 8/2000 |
| JP | 2000-323045 | | 11/2000 |
| JP | 2000-357459 | | 12/2000 |
| JP | 2001-126628 | | 5/2001 |
| JP | 2001-160361 | | 6/2001 |
| JP | 2001-210241 | | 8/2001 |
| JP | 2001-283734 | | 10/2001 |
| JP | 2001-345054 | | 12/2001 |
| JP | 2002-25451 | | 1/2002 |
| JP | 2002-83545 | | 3/2002 |
| JP | 2002-93327 | | 3/2002 |
| JP | 2002-170492 | | 6/2002 |
| JP | 2002-190256 | | 7/2002 |
| JP | 2002-197981 | | 7/2002 |
| JP | 2002-203487 | | 7/2002 |
| JP | 2002-216642 | | 8/2002 |
| JP | 2002-231146 | | 8/2002 |
| JP | 2002-245943 | | 8/2002 |
| JP | 2002-260537 | | 9/2002 |
| JP | 2002-304948 | | 10/2002 |
| JP | 2002-324488 | | 11/2002 |
| JP | 2002-373593 | | 12/2002 |
| JP | 2003-16944 | | 1/2003 |
| JP | 2003-31130 | | 1/2003 |
| JP | 2003-051258 | | 2/2003 |
| JP | 2003-68212 | | 3/2003 |
| JP | 2003-68215 | | 3/2003 |
| JP | 2003-086106 | | 3/2003 |
| JP | 2003-132805 | | 5/2003 |
| JP | 2003-157773 | | 5/2003 |
| JP | 2003-303550 | | 10/2003 |
| JP | 2003-303551 | | 10/2003 |
| JP | 2004-039309 | | 5/2004 |
| JP | 2004-164885 | | 6/2004 |
| KR | 1998-030878 | | 8/1998 |
| KR | 1999-0062632 | | 7/1999 |
| KR | 1999-0065408 | | 8/1999 |
| KR | 2001-0016651 | | 3/2001 |
| KR | 2001-0062222 | | 7/2001 |
| KR | 2001-0093724 | | 10/2001 |
| KR | 2002-0036012 | | 5/2002 |
| KR | 2002-0055807 | | 7/2002 |
| KR | 2002-0069025 | | 8/2002 |
| KR | 2003-0033658 | | 5/2003 |
| KR | 10-2003-0042538 | | 6/2003 |
| KR | 2003-0044667 | | 6/2003 |
| KR | 2003-0061079 | | 7/2003 |
| KR | 10-2004-0032508 | | 4/2004 |
| WO | WO99/50877 | | 10/1999 |
| WO | WO00/46832 | | 8/2000 |

OTHER PUBLICATIONS

U.S. Notice of Allowance dated Mar. 3, 2009, for related U.S. Appl. No. 10/871,427, indicating relevance of listed U.S. reference in this IDS, namely, U.S. 2005/0134176.

Patent Abstracts of Japan, Publication No. 07-065728, dated Mar. 10, 1995, in the name of Tatsutoshi Kanae et al.
Patent Abstracts of Japan, Publication No. 11-031460, dated Feb. 2, 1999, in the name of Takaaki Murata et al.
Patent Abstracts of Japan, Publication No. 2000-082407, dated Mar. 21, 2000, in the name of Toshihiro Komaki et al.
Patent Abstracts of Japan, Publication No. 2000-113828, dated Apr. 21, 2000, in the name of Masaki Kuroki et al.
Patent Abstracts of Japan, Publication No. 2002-093327, dated Mar. 29, 2002, in the name of Masaki Aoki et al.
English translation for KR 10-2003-0042538 A, dated Jun. 2, 2003, listed above.
U.S. Office action dated Aug. 22, 2008, for corresponding U.S. Appl. No. 10/929,626, indicating relevance of references listed in this IDS.
Japanese Office action dated Sep. 14, 2010, for corresponding Japanese Patent application 2008-121662, noting listed Japanese reference in this IDS, as well as other Japanese references previously filed in an IDS dated Dec. 6, 2007.
U.S. Appl. No. 10/751,341, filed Jan. 2, 2004, Kwon, et al.
U.S. Appl. No. 10/746,540, filed Dec. 23, 2003, Kwon, et al.
U.S. Appl. No. 10/746,541, filed Dec. 23, 2003, Kwon et al.
Patent Abstracts of Japan for Publication No. 10-283934; Date of publication of application: Oct. 23, 1998, in the name of Tsutomu Tokunaga et al.
Patent Abstracts of Japan for Publication No. 11-345570; Date of publication of application: Dec. 14, 1999, in the name of Takaaki Murata et al.
Patent Abstracts of Japan for Publication No. 2000-011899; Date of publication of application: Jan. 14, 2000, in the name of Kimio Amamiya.
Patent Abstracts of Japan for Publication No. 2000-021313; Date of publication of application: Jan. 21, 2000, in the name of Kenji Yoshida et al.
Patent Abstracts of Japan for Publication No. 2000-323045; Date of publication of application: Nov. 24, 2000, in the name of Kazuki Takagi et al.
Patent Abstracts of Japan for Publication No. 2001-283734; Date of publication of application: Oct. 12, 2001, in the name of Sukeyuki Nishimura et al.
Patent Abstracts of Japan for Publication No. 2002-373593; Date of publication of application: Dec. 26, 2002, in the name of Hiroshi Kanda.
Patent Abstract of Japan, Publication No. 10-149771, Published on Jun. 2, 1998, in the name of Yatsuda, et al.
Patent Abstract of Japan, Publication No. 2001-345054, Published on Dec. 14, 2001, in the name of Sano, et al.
Patent Abstract of Japan, Publication No. 2002-231146, Published on Aug. 16, 2002, in the name of Yura, et al.
European Patent Office Search Report, dated Feb. 3, 2005, for application No. 04090020.1, in the name of Samsung SDI Co., Ltd.
Korean Patent Abstracts for publication No. 1020030061079, with a date of publication of Jul. 18, 2003, in the name of Y. Ahn et al.
Korean Patent Abstracts for publication No. 1020010093724, with a date of publication of Oct. 29, 2001, in the name of K. Morikawa et al.
Korean Patent Abstracts for publication No. 1020040032508, with a date of publication of Apr. 17, 2004, in the name of B. Lee.
Patent Abstracts of Japan for publication No. 2001-210241, with a date of publication of Aug. 3, 2001, in the name of T. Kosaka.
Patent Abstracts of Japan for publication No. 2002-083545, with a date of publication of Mar. 22, 2002, in the name of Y. Kunii et al.
Patent Abstracts of Japan for publication No. 2000-195431, with a publication date of Jul. 14, 2000, in the name of T. Komaki et al.
Patent Abstracts of Japan for publication No. 2003-303551, with a publication date of Oct. 24, 2003, in the name of S. Kan.
Patent Abstracts of Japan for publication No. 2003303550, with a publication date of Oct. 24, 2003, in the name of S. Kan.
Patent Abstracts of Japan, Publication No. 2002-190256, Date of Publication May 7, 2002, in the name of Takada, et al.
Korean Patent Abstracts for Publication No. 1020010062222, publication date of Jul. 7, 2001, in the name of K. Amemiya et al.
Patent Abstracts of Japan for Publication No. 2002-245943, publication date of Aug. 30, 2002, in the name of K. Morikawa et al.
Korean Patent Abstracts for Publication No. 1019990065408A, publication date of Aug. 5, 1999, in the name of S. Lee.
Patent Abstracts of Japan for Publication No. 10-308179, Date of publication of application Nov. 17, 1998, in the name of K. Aoto et al.
Patent Abstracts of Japan for Publication No. 2001-160361; Date of publication of application Jun. 12, 2001, in the name of S. Yura et al.
Patent Abstracts of Japan for Publication No. 2002-324488; Date of publication of application Nov. 8, 2002, in the name of N. Hirano et al.
Patent Abstracts of Japan for Publication No. 04-298936; Date of publication of application Oct. 22, 1992, in the name of T. Okajima.
Korean Utility Model Abstracts for Publication No. 2019980030878; Date of Publication of application Aug. 17, 1998, in the name of B. Choi.
Korean Patent Abstracts for Publication No. 1020020036012; Date of publication of application May 16, 2002, in the name of U. Kim.
Patent Abstracts of Japan, Publication No. 05-094772; Publication Date: Apr. 16, 1993; in the name of Noborio.
Patent Abstracts of Japan, Publication No. 10-334811; Publication Date: Dec. 18, 1998; in the name of Aoki et al.
Patent Abstracts of Japan, Publication No. 11-096921; Publication Date: Apr. 9, 1999; in the name of Tomioka et al.
Patent Abstracts of Japan, Publication No. 11-317170; Publication Date: Nov. 16, 1999; in the name of Kado et al.
Patent Abstracts of Japan, Publication No. 2000-042661; Publication Date: Feb. 15, 2000; in the name of Arima et al.
Patent Abstracts of Japan, Publication No. 2000-357459; Publication Date: Dec. 26, 2000; in the name of Jae et al.
Patent Abstracts of Japan, Publication No. 2002-260537; Publication Date: Sep. 13, 2002; in the name of Ito et al.
Korean Patent Abstracts, Publication No. 1020010016651 A; Publication Date: Mar. 5, 2001; in the name of Park.
Korean Patent Abstracts, Publication No. 1020020055807 A; Publication Date: Jul. 10, 2002; in the name of Kim.
Korean Patent Abstracts, Publication No. 1020030044667 A; Publication Date: Jun. 9, 2003; in the name of Lee.
Patent Abstracts of Japan, Publication No. 06-342631, Published Dec. 13, 1994 in the name of Noborio.
Patent Abstracts of Japan, Publication No. 10-269951, Published Oct. 9, 1998 in the name of Fumihiro.
Patent Abstracts of Japan, Publication No. 11-213893, Published Aug. 6, 1999 in the name of Toshie et al.
Patent Abstracts of Japan, Publication No. 2000-187200, Published Jul. 4, 2000 in the name of Pascale et al.
Patent Abstracts of Japan, Publication No. 2002-025451, Published Jan. 25, 2002 in the name of Toshihiko et al.
Patent Abstracts of Japan, Publication No. 2002-197981, Published Jul. 12, 2002 in the name of Toshihiro et al.
Patent Abstracts of Japan, Publication No. 2003-016944, Published Jan. 17, 2003 in the name of Kimio.
Patent Abstracts of Japan, Publication No. 2003-031130, Published Jan. 31, 2003in the name of Eishiro et al.
Patent Abstracts of Japan, Publication No. 2003-068212, Published Mar. 7, 2003 in the name of Naoki et al.
Patent Abstracts of Japan, Publication No. 2003-068215, Published Mar. 7, 2003 in the name of Shuichi et al.
Patent Abstracts of Japan, Publication No. 2003-132805. Published May 9, 2003 in the name of Tomohiro et al.
Patent Abstract of Japan, Publication No. 2004-164885, Published Jun. 10, 2004 in the name of Takashi et al.
Patent Abstracts of Japan for 2002-203487 dated Jul. 19, 2002 in the name of S. Shiromizu.
Patent Abstracts of Japan, Publication No. 6-044907, dated Feb. 18, 1994, in the name of Tetsuji Okajima.
Patent Abstracts of Japan, Publication No. 2003-157773, dated May 30, 2003, in the name of Tomohiro Kimura et al.
Korean Patent Abstracts for Publication No. 1020030033658; dated May 1, 2003, in the name of Gwang Yeol Choi.
Patent Abstracts of Japan, Publication No. 06-044907, dated Feb. 18, 1994, in the name of Tetsuji Okajima.
Korean Patent Abstracts, Publication No. 1020030033658, dated May 1, 2003, in the name of Gwang Yeol Choi.

Patent Abstracts of Japan, Publication No. 2000-228150, dated Aug. 15, 2000, in the name of Naoto Hirano et al.
Patent Abstracts of Japan, Publication No. 2001-126628, dated May 11, 2001, in the name of Takahiro Torisaki et al.
Patent Abstracts of Japan, Publication No. 2002-216642, dated Aug. 2, 2002, in the name of Kiyoshi Chiyoda.
Patent Abstracts of Japan, Publication No. 2003-051258, dated Feb. 21, 2003, in the name of Keisuke Sumita et al.
Patent Abstracts of Japan, Publication No. 2003-086106, dated Mar. 20, 2003, in the name of Hiroshi Mori et al.
U.S. Office action dated Dec. 4, 2008, for related U.S. Appl. No. 10/999,231, indicating relevance of listed U.S. Patents in this IDS.
Japanese Office action dated Dec. 7, 2010, for corresponding Japanese Patent application 2007-163147, noting listed reference in this IDS, as well as several references previously filed in an IDS dated Dec. 6, 2007.
Patent Abstracts of Japan and English machine translation of Japanese Publication 2002-304948 listed above, 11 pages.

* cited by examiner

PLASMA DISPLAY PANEL

CROSS REFERENCE TO RELATED APPLICATIONS

This application is a divisional application of U.S. patent application Ser. No. 10/867,857 filed on Jun. 14, 2004, which claims priority to and the benefit of Korea Patent Applications: No. 2003-0041491 filed on Jun. 25, 2003, No. 2003-0044861 filed on Jul. 3, 2003, No. 2003-0050278 filed on Jul. 22, 2003, No. 2003-0052598 filed on Jul. 30, 2003, No. 2003-0053461 filed on Aug. 1, 2003, No. 2003-0073518 filed on Oct. 21, 2003 and No. 2003-0073519 filed on Oct. 21, 2003, all in the Korean Intellectual Property Office, the entire content of which are incorporated herein by reference.

BACKGROUND OF THE INVENTION (a) Field of the Invention

The present invention relates to a plasma display panel (PDP), and more particularly, to a plasma display panel having a structure preventing the reflection of external light to improve screen contrast.

(b) Description of the Related Art

A PDP is typically a display device in which vacuum ultraviolet rays generated by the discharge of gas occurring in discharge cells excite phosphors to realize predetermined images. As a result of the high resolution possible with PDPs (even with large screen sizes), many believe that they will become a major, next generation flat panel display configuration.

In a conventional PDP, with reference to FIG. 24, address electrodes 101 are formed along one direction (direction X in the drawing) on rear substrate 100. Dielectric layer 103 is formed over an entire surface of rear substrate 100 on which address electrodes 101 are located such that dielectric layer 103 covers address electrodes 101. Barrier ribs 105 are formed on dielectric layer 103 in a striped pattern and at locations corresponding to between address electrodes 101. Formed between barrier ribs 105 are red, green, and blue phosphor layers 107.

Formed on a surface of front substrate 110 facing rear substrate 100 are discharge sustain electrodes 112, 113 realized through a pair of transparent electrodes and bus electrodes 113. Discharge sustain electrodes 112, 113 are arranged in a direction substantially perpendicular to address electrodes 101 of rear substrate 100 (direction Y). Dielectric layer 116 is formed over an entire surface of front substrate 110 on which discharge sustain electrodes 112, 113 are formed such that dielectric layer 116 covers discharge sustain electrodes 114. MgO protection layer 118 is formed covering entire dielectric layer 116.

Areas between where address electrodes 101 of rear substrate 100 and discharge sustain electrodes 112, 113 of front substrate 110 intersect become areas that form discharge cells. Each of the discharge cells are filled with discharge gas.

An address voltage Va is applied between address electrodes 101 and one of discharge sustain electrodes 112, 113 to perform address discharge and thereby select discharge cells in which illumination is to occur, then a sustain voltage Vs is applied between a pair of the discharge sustain electrodes 112, 113 to perform sustain discharge. Vacuum ultraviolet rays (VUV) generated at this time excite corresponding phosphor layers such that visible light is emitted through transparent front substrate 110 to realize the display of images.

The PDP operating in this manner has a bright room contrast and a dark room contrast to a level exhibiting a contrast ratio. Bright room contrast refers to the contrast when a light source of 150 lux or greater exists to the exterior of the panel and the PDP receives the affect of the external light. Dark room contrast refers to the contrast when a light source of 21 lux or less exists to the exterior of the panel and the PDP receives no substantial affect of the external light.

In conventional PDPs, front substrate 110 is made of a transparent glass material such that the reflection of external light is unavoidable. The reflection of external light occurs when light from outside the panel passes through front substrate 110, reaches the discharge cells, and is reflected on phosphor layers 107 or dielectric layer 116. External light also reflects directly on an outer surface of front substrate 110.

In the case where external light passes through front substrate 110 to be reflected on either phosphor layers 107 or dielectric layer 116, the brightness of black display is increased. This reduces the dark room contrast of the screen. When external light is reflected directly from the outer surface of front substrate 116, part of the screen is shielded and therefore cannot be seen. This causes a decrease in the bright room contrast of the screen.

Accordingly, a light shielding film is formed between the discharge sustain electrodes 112, 113 of the conventional PDP such that light entering through front substrate 110 is blocked and prevented from being reflected. This is a common configuration used in PDPs. U.S. Pat. Nos. 5,952,782 and 6,200,182 disclose PDPs using such light shielding films between the front substrate and the phosphor layers.

However, with the mounting of light shielding films on the inner surface of the front substrate and therefore adjacent to areas of discharge, the material in the light shielding films used to block light negatively affects the discharge operation so that discharge does not occur normally. Further, the light shielding films are unable to prevent reflection from the outer surface of the front substrate. This may cause problems (i.e., significant reflection) when the PDP is placed in a room using fluorescent lights or other such high-intensity lighting, thereby being unable to prevent a reduction in bright room contrast.

Color characteristics of red, green, and blue phosphor layers determine the color temperature of the screen. The phosphors of these different color layers used in conventional systems have differing phosphor efficiencies and therefore varying brightness ratios. Accordingly, in order to improve color temperature, it is necessary to compensate for the phosphor with the lowest brightness ratio among these three colors of phosphors.

The typical method used to perform such color compensation in conventional PDPs is to perform gamma compensation so that peak values for the different colors are reduced. This is performed prior to digitizing analog image signals for the colors that do not have the lowest brightness ratios, for example, the red and green colors (assuming for the sake of this example that blue has the lowest brightness ratio). Therefore, the number of sustain pulses, which indicate maximum brightnesses of red and green, is reduced to below the number for blue. Further, the discharge cells containing the phosphor layers of the color exhibiting the lowest brightness ratio are made the largest, while the volumes for the discharge cells containing the phosphor layer of the other two colors are reduced in size. This further improves color temperature.

However, in the method utilizing gamma compensation described above, not all 255 sustain pulses needed for maximum green and red brightness are used. As a result, for images that gradually become bright or dark, green and red colors in the images realize such changes in increments and not in a gradual manner. Further, with the use of discharge cells of differing sizes, the likelihood of mis-discharge occurring increases, and a voltage margin, needed for stable driving, decreases.

SUMMARY OF THE INVENTION

In accordance with the present invention, a plasma display panel is provided that improves screen contrast by effectively preventing the reflection of external light from an outer surface of a front substrate while not causing any abnormalities in illumination in discharge cells.

Further, in accordance with the present invention, a plasma display panel is provided in which an internal structure of the panel is improved such that an area of external light absorption is increased or external light reflection is minimized, thereby enhancing bright room contrast of the screen.

In addition, in accordance with the present invention, a plasma display panel is provided that compensates for a color, among red, green, and blue colors, having the lowest brightness ratio to thereby improve color temperature and prevent external light reflection so that a dark/bright ratio is improved.

A plasma display panel includes a first substrate and a second substrate provided opposing one another with a predetermined gap therebetween. Address electrodes are formed on the second substrate. Barrier ribs are mounted between the first substrate and the second substrate, the barrier ribs defining a plurality of discharge cells and a plurality of non-discharge regions. A phosphor layer is formed within each of the discharge cells. Discharge sustain electrodes are formed on the first substrate in a direction intersecting the address electrodes. The non-discharge regions are formed in areas encompassed by discharge cell abscissas that pass through centers of adjacent discharge cells and discharge cell ordinates that pass through centers of adjacent discharge cells. The non-discharge regions are at least as large as distal ends of the barrier ribs forming the discharge cells. External light absorbing members are formed between the second substrate and the barrier ribs layer at areas corresponding to locations of the non-discharge regions.

The external light absorbing members have a planar shape that is similar to a planar shape of the non-discharge regions.

The barrier ribs defining adjacent discharge cells form the non-discharge regions into a cell structure. The non-discharge regions are formed by the barrier ribs separating diagonally adjacent discharge cells.

Each of the discharge cells is formed such that ends of the discharge cells gradually decrease in width along a direction the discharge sustain electrodes are formed as a distance from a center of the discharge cells is increased along a direction the address electrodes are formed. Also, the barrier ribs comprise first barrier rib members formed substantially parallel the direction of the address electrodes. Second barrier rib members are connected to the first barrier rib members and formed in a direction that is oblique to the direction of the address electrodes. The second barrier rib members are formed at a predetermined angle to the direction the address electrodes are formed to intersect over the address electrodes.

The external light absorbing members are adjacent to the dielectric layer.

The external light absorbing members may be formed on the dielectric layer. Also, grooves may be formed in the dielectric layer at areas corresponding to the location of the non-discharge regions, and the external light absorbing members may be positioned in the grooves. The external light absorbing members may be formed of black films.

The external light absorbing members may be realized by forming areas of the dielectric layer corresponding to locations of the non-discharge regions as tinted sections that are able to absorb external light.

The tinted sections are made of one of black coloring, blue coloring, and a mixture of black coloring and blue coloring. The black coloring is selected from the group consisting of FeO, $RuO_2$, TiO, $Ti_3O_5$, $Ni_2O_3$, $CrO_2$, $MnO_2$, $Mn_2O_3$, $Mo_2O_3$, $Fe_3O_4$, and any combination of these compounds. The blue coloring is selected from the group consisting of $Co_2O_3$, CoO, $Nd_2O_3$, and any combination of these compounds.

Each of the discharge sustain electrodes includes bus electrodes that extend such that a pair of the bus electrodes is provided for each of the discharge cells. Protrusion electrodes are formed extending from each of the bus electrodes such that a pair of opposing protrusion electrodes is formed within areas corresponding to each discharge cell. The protrusion electrodes are formed such that proximal ends decrease in width along a direction the discharge sustain electrodes are formed as a distance from a center of the discharge cells is increased along a direction the address electrodes are formed. A distal end of each of the protrusion electrodes opposite proximal ends connected to and extended from the bus electrodes is formed including an indentation. A first discharge gap and a second discharge gap of different sizes are formed between distal ends of opposing protrusion electrodes.

The discharge cells may be filled with discharge gas containing 10% or more Xenon, or containing 10-60% Xenon.

The discharge sustain electrodes include scan electrodes and display electrodes provided such that one scan electrode and one display electrode correspond to each row of the discharge cells, the scan electrodes and the display electrodes including protrusion electrodes that extend into the discharge cells while opposing one another. The protrusion electrodes are formed such that a width of proximal ends thereof is smaller than a width of distal ends of the protrusion electrodes. The address electrodes include line regions formed along a direction the address electrodes are formed. Enlarged regions are formed at predetermined locations and expand along a direction substantially perpendicular to the direction of the line regions to correspond to the shape of protrusion electrodes of the scan electrodes.

The enlarged regions of the address electrodes are formed to a first width at areas opposing the distal ends of the protrusion electrodes, and to a second width that is smaller than the first width at areas opposing the proximal ends of the protrusion electrodes.

The discharge sustain electrodes include scan electrodes and display electrodes provided such that one scan electrode and one display electrode correspond to each row of the discharge cells. Each of the scan electrodes and display electrodes includes bus electrodes extended along a direction substantially perpendicular to the direction the address electrodes are formed. Protrusion electrodes extend into the discharge cells from the bus electrodes such that the protrusion electrodes of the scan electrodes oppose the protrusion electrodes of the display electrodes. One of the bus electrodes of the display electrodes is mounted between adjacent discharge cells of every other row of the discharge cells. The bus electrodes of the scan electrodes are mounted between adjacent discharge cells and between the bus electrodes of the display electrodes.

The protrusion electrodes of the display electrodes are extended from the bus electrodes of the display electrodes into discharge cells adjacent to opposite sides of the bus electrodes. The bus electrodes of the display electrodes have a width that is greater than a width of the bus electrodes of the scan electrodes.

A method is provided for manufacturing a plasma display panel having a plasma discharge structure defining non-discharge regions and discharge cells between a first substrate and a second substrate. The method includes forming address electrodes on a surface of the second substrate opposing the first substrate; forming a dielectric layer on the second substrate covering the address electrodes; forming external light absorbing members adjacent to the dielectric layer and at areas corresponding to locations of the non-discharge regions; forming barrier ribs on the dielectric layer such that the barrier ribs define the discharge cells and the non-discharge regions; and forming a phosphor layer within each of the discharge cells.

The forming external light absorbing members includes depositing black coloring on the dielectric layer, or forming grooves in the dielectric layer at areas corresponding to where the non-discharge regions are to be formed, and depositing black coloring in the grooves.

In another embodiment, a plasma display panel includes a first substrate and a second substrate provided opposing one another with a predetermined gap therebetween. Address electrodes are formed on the second substrate. Barrier ribs are mounted between the first substrate and the second substrate, the barrier ribs defining a plurality of discharge cells and a plurality of non-discharge regions. A phosphor layer is formed within each of the discharge cells; and discharge sustain electrodes formed on the first substrate in a direction intersecting the address electrodes. The non-discharge regions are formed in areas encompassed by discharge cell abscissas that pass through centers of adjacent discharge cells and discharge cell ordinates that pass through centers of adjacent discharge cells. The non-discharge regions are at least as large as distal ends of the barrier ribs forming the discharge cells. External light absorbing members are formed on an outer surface of the first substrate at areas corresponding to locations of the non-discharge regions.

Grooves are formed to a predetermined depth in the outer surface of the first substrate at areas corresponding to the location of the non-discharge regions. Light absorbing material is filled in the grooves. In one embodiment, the predetermined depth is 100-300 μm. In one embodiment, the light absorbing material is black.

In yet another embodiment, a plasma display panel includes a first substrate and a second substrate provided opposing one another with a predetermined gap therebetween. Address electrodes are formed on the second substrate. Barrier ribs mounted between the first substrate and the second substrate, the barrier ribs defining a plurality of discharge cells and a plurality of non-discharge regions. A red, green, or blue phosphor layer is formed within each of the discharge cells. Discharge sustain electrodes are formed on the first substrate in a direction intersecting the address electrodes. The non-discharge regions are formed in areas encompassed by discharge cell abscissas that pass through centers of adjacent discharge cells and discharge cell ordinates that pass through centers of adjacent discharge cells. The non-discharge regions are at least as large as distal ends of the barrier ribs forming the discharge cells. Color compensating members have a coloration corresponding to a color of the phosphor layers having the lowest brightness ratio among the three colors of the phosphor layers, the color compensating members being formed at areas corresponding to locations of the non-discharge regions, and at one of the locations of on the first substrate, and between the first substrate and the second substrate.

The color compensating members include one of red coloration, green coloration, and blue coloration.

The color compensating members are formed on an inner surface of the first substrate, or in the non-discharge regions.

Barrier ribs defining adjacent discharge cells form the non-discharge regions into a cell structure, and the color compensating members are formed within the cells forming the non-discharge regions.

The color compensating members may be formed on an inner surface of the first substrate and in the non-discharge regions, or on an outer surface of the first substrate.

The color compensating members include grooves formed to a predetermined depth in an outer surface of the first substrate, and color layers filled in the grooves. In one embodiment, the predetermined depth is 100-300 μm.

The color compensating members have a planar shape that is similar to a planar shape of the non-discharge regions. In one embodiment, the color compensating members have a combined area that is 50% or less an area of the first substrate.

BRIEF DESCRIPTION OF THE DRAWINGS

FIG. 6*b* is a sectional view taken along line C-C of FIG. 6*a*, and FIG. 7*b* is a sectional view taken along line D-D of FIG. 7*a*.

DETAILED DESCRIPTION

Figure 1:
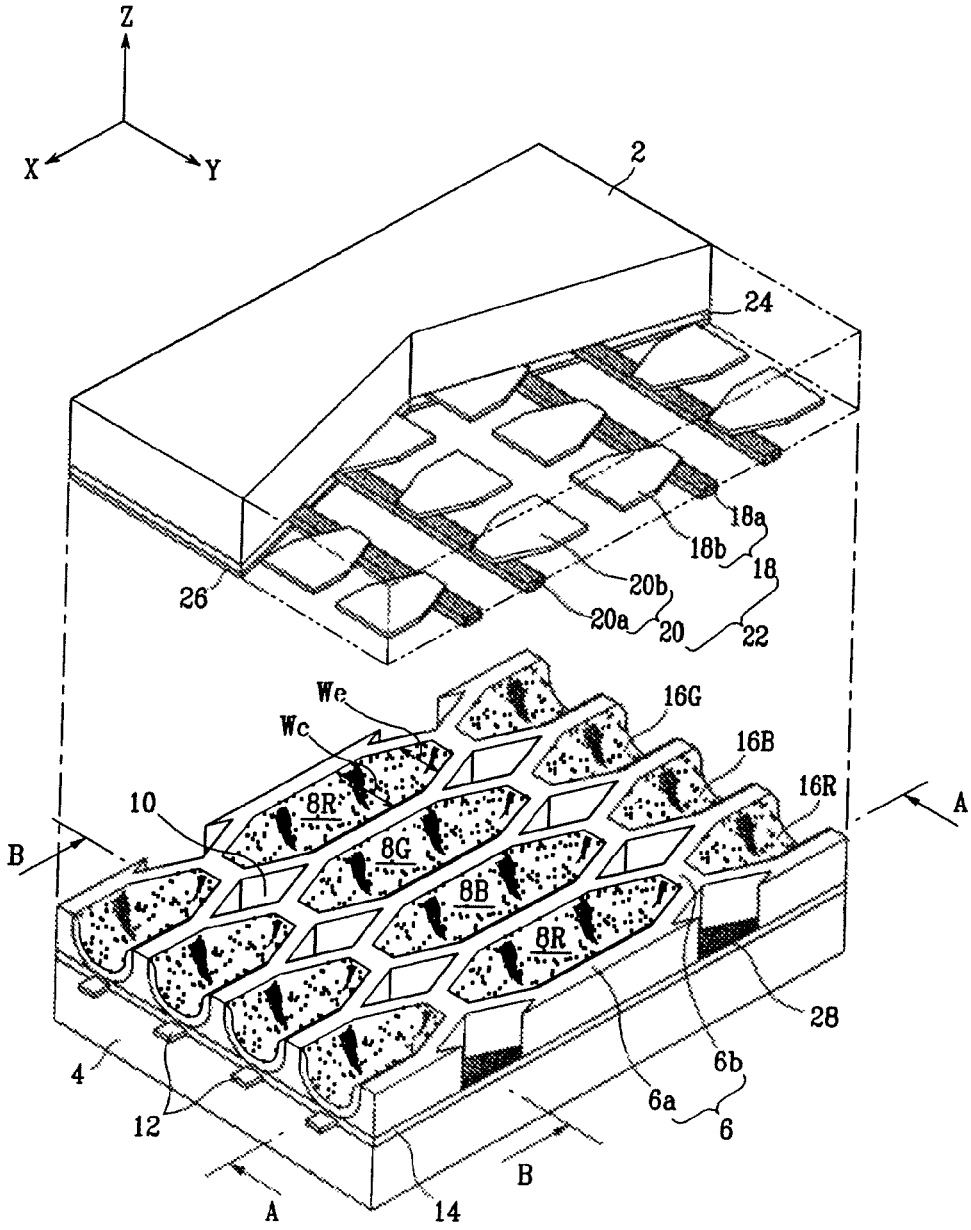
FIG. 1 is a partial exploded perspective view of a plasma display panel according to a first embodiment of the present invention.
Figure 2:
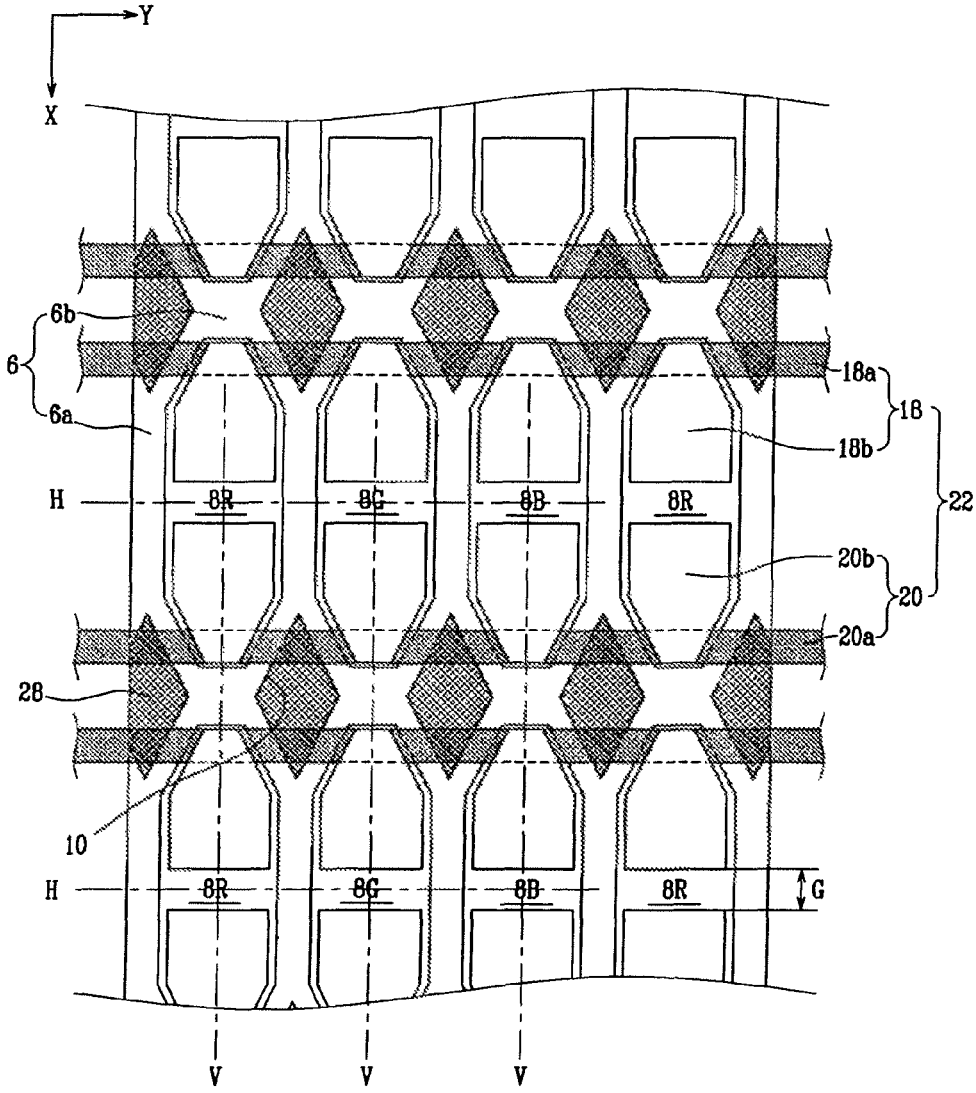
FIG. 2 is a partial plan view of the plasma display panel of FIG. 1.
Figure 3:
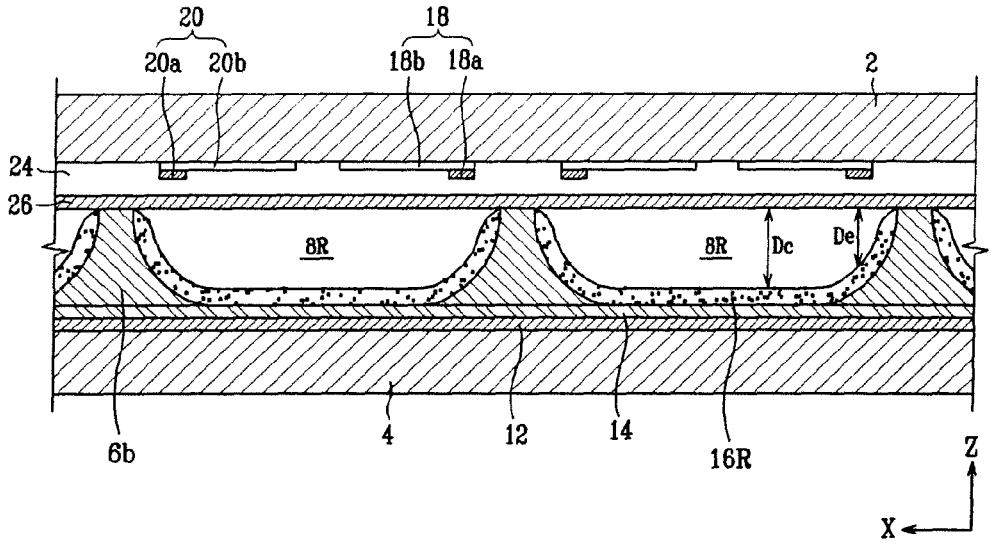
FIG. 3 is a sectional view taken along line A-A of FIG. 1.

FIG. 1 is a partial exploded perspective view of a plasma display panel according to a first embodiment of the present invention. FIG. 2 is a partial plan view of the plasma display panel of FIG. 1. FIG. 3 is a sectional view taken along line A-A of FIG. 1.

A plasma display panel (PDP) according to the first embodiment includes first substrate 2 and second substrate 4 provided substantially in parallel with a predetermined gap therebetween. Non-discharge regions 10 and discharge cells 8R, 8G, 8B are defined by barrier ribs 6 between first substrate 2 and second substrate 4.

A plurality of address electrodes 12 is formed along one direction (direction X in the drawings) on a surface of second substrate 4 opposing first substrate 2. As an example, address electrodes 12 are formed in a striped pattern with a uniform, predetermined interval between adjacent address electrodes 12. Dielectric layer 14 is formed on second substrate 4 covering address electrodes 12.

Barrier ribs 6 define the plurality of discharge cells 8R, 8G, 8B, and also non-discharge regions 10 in the gap between first substrate 2 and second substrate 4. In one embodiment barrier ribs 6 are formed over dielectric layer 14, which is provided on second substrate 4 as described above. Discharge cells 8R, 8G, 8B designate areas in which discharge gas is provided and where gas discharge is expected to take place with the application of an address voltage and a discharge sustain voltage. Non-discharge regions 10 are areas where a voltage is not applied such that gas discharge (i.e., illumination) is not expected to take place therein. Non-discharge regions 10 are areas that are at least as big as a thickness of barrier ribs 6 in a direction Y.

Referring to FIGS. 1 and 2, non-discharge regions 10 defined by barrier ribs 6 are formed in areas encompassed by discharge cell abscissas H and ordinates V that pass through centers of each of the discharge cells 8R, 8G, 8B and that are respectively aligned with direction Y and direction X. In one embodiment, non-discharge regions 10 are centered between adjacent abscissas H and adjacent ordinates V. Stated differently, in one embodiment each pair of discharge cells 8R, 8G, 8B adjacent to one another along direction X has a common non-discharge region 10 with another such pair of discharge cells 8R, 8G, 8B adjacent along direction Y. With this configuration realized by barrier ribs 6, each of the non-discharge regions 10 has an independent cell structure.

Barrier ribs 6 define discharge cells 8R, 8G, 8B in a direction of address electrodes 12 (direction X), and in a direction substantially perpendicular to the direction address electrodes 12 are formed (direction Y). Discharge cells 8R, 8G, 8B are formed in a manner to optimize gas diffusion. In particular, each of the discharge cells 8R, 8G, 8B is formed with ends that reduce in width along direction Y as a distance from a center of each of the discharge cells 8R, 8G, 8B is increased in the direction address electrodes 12 are provided (direction X). That is, as shown in FIG. 1, a width Wc of a mid-portion of discharge cells 8R, 8G, 8B is greater than a width We of the ends of discharge cells 8R, 8G, 8B with width We of the ends decreasing up to a certain point as the distance from the center of the discharge cells 8R, 8G, 8B is increased. Therefore, in the first embodiment, the ends of discharge cells 8R, 8G, 8B are formed in the shape of a trapezoid (with its base removed) until reaching a predetermined location where barrier ribs 6 close off discharge cells 8R, 8G, 8B. This results in each of the discharge cells 8R, 8G, 8B having an overall planar shape of an octagon.

Barrier ribs 6 defining non-discharge regions 10 and discharge cells 8R, 8G, 8B in the manner described above include first barrier rib members 6*a* that are parallel to address electrodes 12, and second barrier rib members 6*b* that define the ends of discharge cells 8R, 8G, 8B as described above and so are not parallel to address electrodes 12. In the first embodiment, second barrier rib members 6*b* are formed extending up to a point at a predetermined angle to first barrier rib members 6*a*, then extending in direction Y to cross over address electrodes 12. Therefore, second barrier rib members 6*b* are formed in substantially an X shape between discharge cells 8R, 8G, 8B adjacent along the direction of address electrodes 12. Second barrier rib members 6*b* can further separate diagonally adjacent discharge cells with a non-discharge region therebetween.

Red (R), green (G), and blue (B) phosphors are deposited within discharge cells 8R, 8G, 8B to form phosphor layers 16R, 16G, 16B, respectively.

With reference to FIG. 3, a depth at both ends of discharge cells 8R along the direction of address electrodes 12 decreases as the distance from the center of discharge cells 8R is increased. That is, a depth De at the ends of discharge cells 8R is less than a depth Dc at the mid-portions of discharge cells 8R, with the depth De decreasing as the distance from the center is increased along direction X. Discharge cells 8G, 8B of the other colors are formed identically to discharge cells 8R and therefore operate in the same manner.

With respect to first substrate 2, a plurality of discharge sustain electrodes 22 is formed on the surface of first substrate 2 opposing second substrate 4. Discharge sustain electrodes 22 include scan electrodes 18 and display electrodes 20 extended in a direction (direction Y) substantially perpendicular to the direction (direction X) of address electrodes 12. Further, dielectric layer 24 is formed over an entire surface of first substrate 2 covering discharge sustain electrodes 22, and MgO protection layer 26 is formed on dielectric layer 24.

Scan electrodes 18 and display electrodes 20 respectively include bus electrodes 18*a*, 20*a* that are formed in a striped pattern, and protrusion electrodes 18*b*, 20*b* that are formed extended from bus electrodes 18*a*, 20*a*, respectively. For each row of discharge cells 8R, 8G, 8B along direction Y, bus electrodes 18*a* are extended into one end of discharge cells 8R, 8G, 8B and bus electrodes 20*a* are extended into an opposite end of discharge cells 8R, 8G, 8B. Therefore, each of discharge cells 8R, 8G, 8B has one of the bus electrodes 18*a* positioned over one end, and one of the bus electrodes 20*a* positioned over its other end.

That is, for each row of discharge cells 8R, 8G, 8B along direction Y, protrusion electrodes 18*b* overlap and protrude from corresponding bus electrode 18*a* into the areas of the discharge cells 8R, 8G, 8B. Protrusion electrodes 20*b* overlap and protrude from the corresponding bus electrode 20*a* into the areas of discharge cells 8R, 8G, 8B. Therefore, one protrusion electrode 18*b* and one protrusion electrode 20*b* are formed opposing one another in each area corresponding to each of the discharge cells 8R, 8G, 8B.

Proximal ends of protrusion electrodes 18*b*, 20*b* (i.e., where protrusion electrodes 18*b*, 20*b* are attached to and extend from bus electrodes 18*a*, 20*a*, respectively) are formed corresponding to the shape of the ends of discharge cells 8R, 8G, 8B. That is, the proximal ends of protrusion electrodes 18*b*, 20*b* reduce in width along direction Y as the distance from the center of discharge cells 8R, 8G, 8B along direction X is increased to thereby correspond to the shape of the ends of discharge cells 8R, 8G, 8B.

Protrusion electrodes 18*b*, 20*b* are realized through transparent electrodes having excellent light transmissivity such as ITO (indium tin oxide) electrodes. In one embodiment, a metal such as silver (Ag), aluminum (Al), and copper (Cu) is used for bus electrodes 18*a*, 20*a*.

External light absorbing members are mounted between second substrate 4 and barrier ribs 6 at areas corresponding to non-discharge regions. The external light absorbing members are provided adjacent to dielectric layer 14 formed on second substrate 4. In the first embodiment, external light absorbing members 28 are formed on dielectric layer 14 corresponding to the areas of non-discharge regions 10 to thereby minimize reflection brightness of the PDP.

Figure 4:
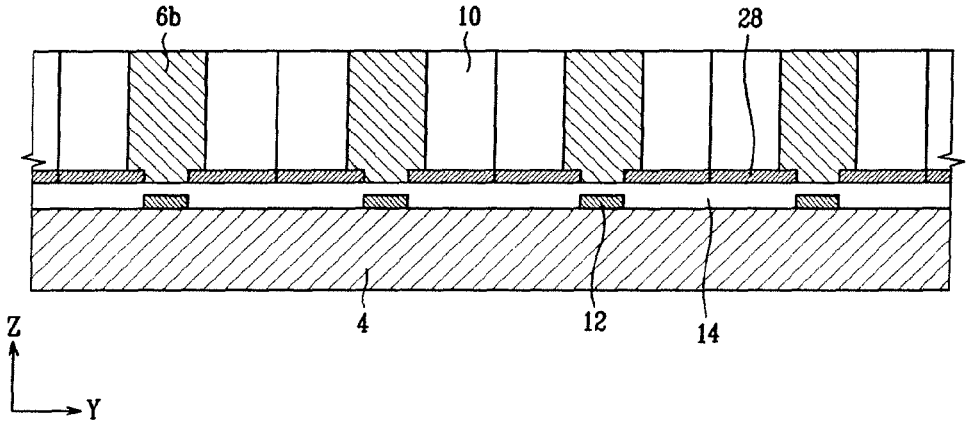
FIG. 4 is a sectional view taken along line B-B of FIG. 1.
Figure 5:
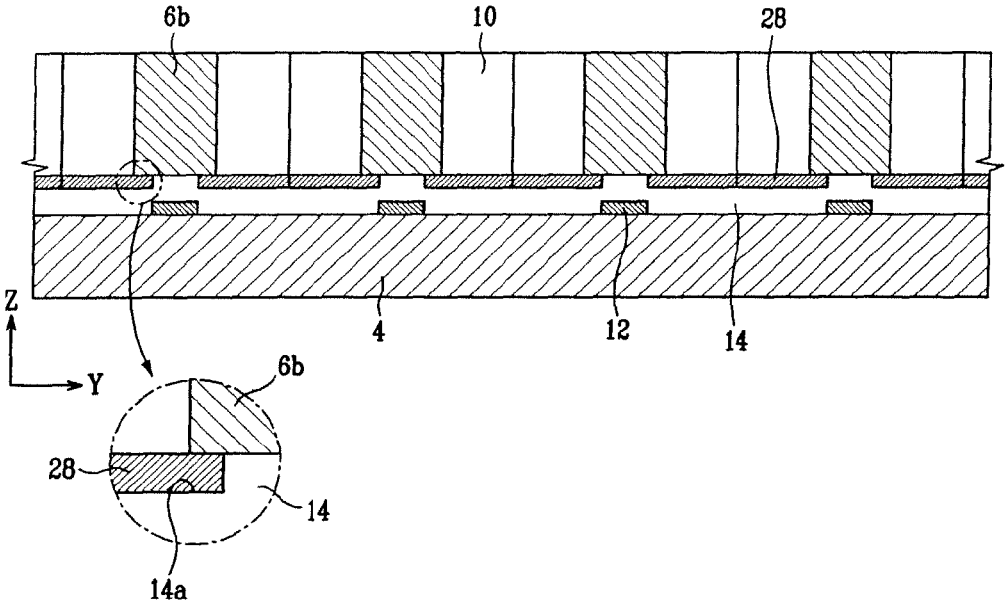
FIG. 5 is a sectional view of a modified example of the plasma display panel of FIG. 1.

FIG. 4 is a sectional view taken along line B-B of FIG. 1. External light absorbing members 28 are made of layers that are black or are a dark shade that is close to black in color. As described above, external light absorbing members 28 are positioned between second substrate 4 and barrier ribs 6 on dielectric layer 14. If desired, external light absorbing members 28 may be provided in grooves 14*a* formed in dielectric layer 14 as shown in FIG. 5. If this configuration of FIG. 5 is used, the difference in heights between dielectric layer 14 and external light absorbing members 28 is removed so that the combined dielectric layer 14 and external light absorbing members 28 is flat.

Frit is provided along edges of first substrate 2 and second substrate 4, and the same are sealed in a state where discharge gas (typically an Ne—Xe compound gas) is filled between first substrate 2 and second substrate 4.

If an address voltage Va is applied between an address electrode 12 and a scanning electrode 18 of a specific discharge cell, for example, a discharge cell 8R, address discharge occurs in discharge cell 8R. As a result, a wall charge accumulates on dielectric layer 24, which covers discharge sustain electrodes 22, to thereby select the specific discharge cell 8R.

Next, if a sustain voltage Vs is applied between scanning electrode 18 and display electrode 20 of the selected discharge cell 8R, plasma discharge is initiated in a gap between scanning electrode 18 and display electrode 20, and VUV rays are emitted by the excitation of Xenon atoms generated during plasma discharge. The VUV rays excite phosphor layer 16R of discharge cell 8R to generate visible light and thereby realize predetermined images.

Plasma discharge generated by sustain voltage Vs is diffused in approximately an arc shape toward exterior regions of discharge cell 8R, and is then extinguished. In the first embodiment, each of the discharge cells 8R, 8G, 8B is formed to correspond to such diffusion of plasma discharge. Therefore, effect sustain discharge occurs over the entire regions of discharge cells 8R, 8G, 8B, thereby increasing discharge efficiency.

Further, the area of contact with phosphor layers 16R, 16G, 16B with respect to discharge areas is increased as exterior regions of discharge cells 8R, 8G, 8B are approached to thereby increase illumination efficiency. Also, non-discharge regions 10 absorb heat emitted from discharge cells 8R, 8G, 8B, and expel this heat to outside the PDP, thereby enhancing heat discharge characteristics of the PDP.

With the mounting of external light absorbing members 28 in the first embodiment, external light entering the PDP through first substrate 2 is absorbed to thereby reduce reflection brightness of the PDP. Ultimately, bright room contrast of the screen is improved.

Manufacture of the PDP according to the first embodiment will now be described with reference to FIGS. 6-10.

Figure 6:
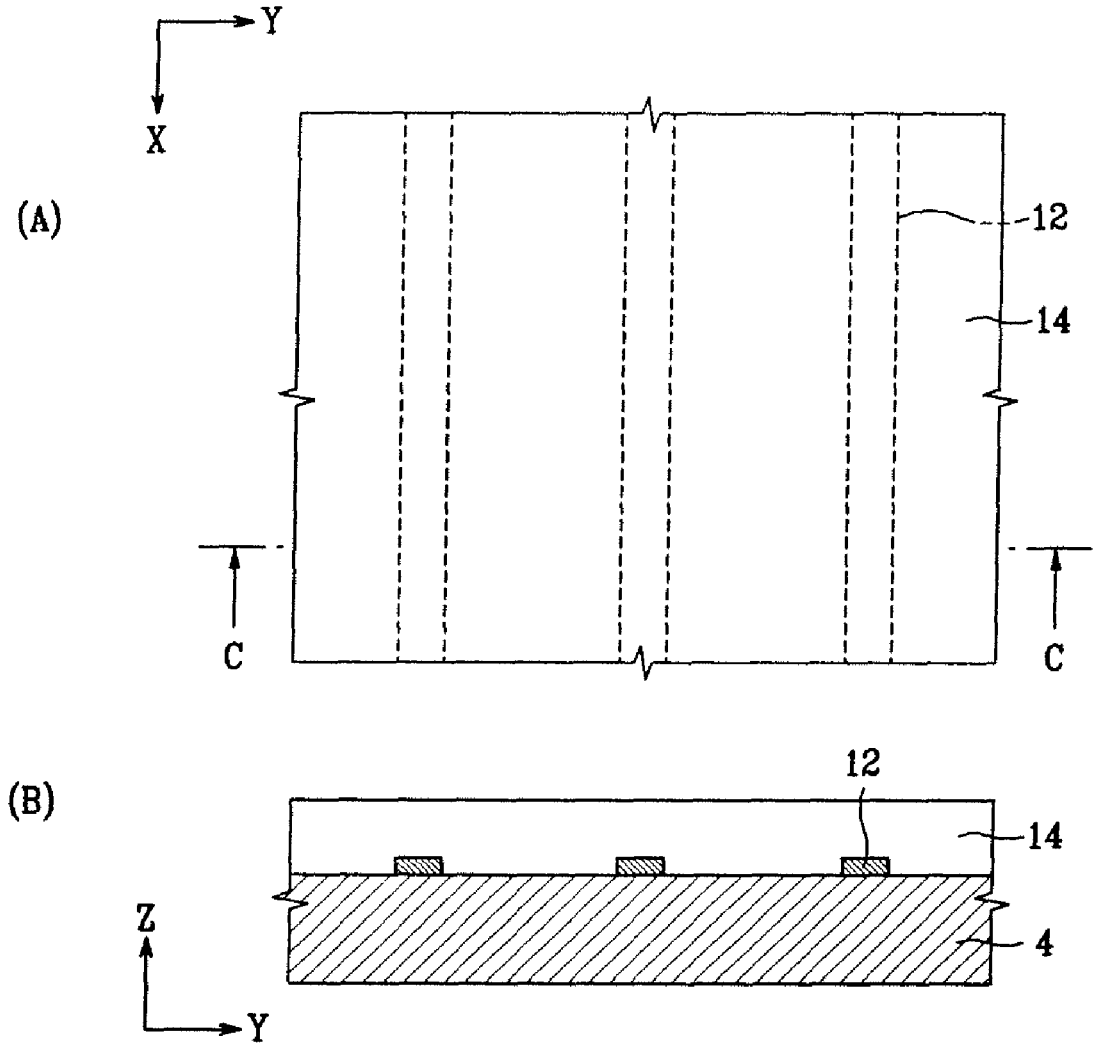
FIGS. 6-10 are schematic views used to describe manufacture of the plasma display panel of FIG. 1, where

Referring first to FIG. 6, a conductive paste such as a silver (Ag) paste is printed on second substrate 4 in a stripe pattern. The conductive paste is dried and fired to form address electrodes 12. Dielectric material is then printed over an entire surface of second substrate 4 on which address electrodes 12 are formed, after which the dielectric material is dried and fired to thereby form dielectric layer 14.

Figure 7:
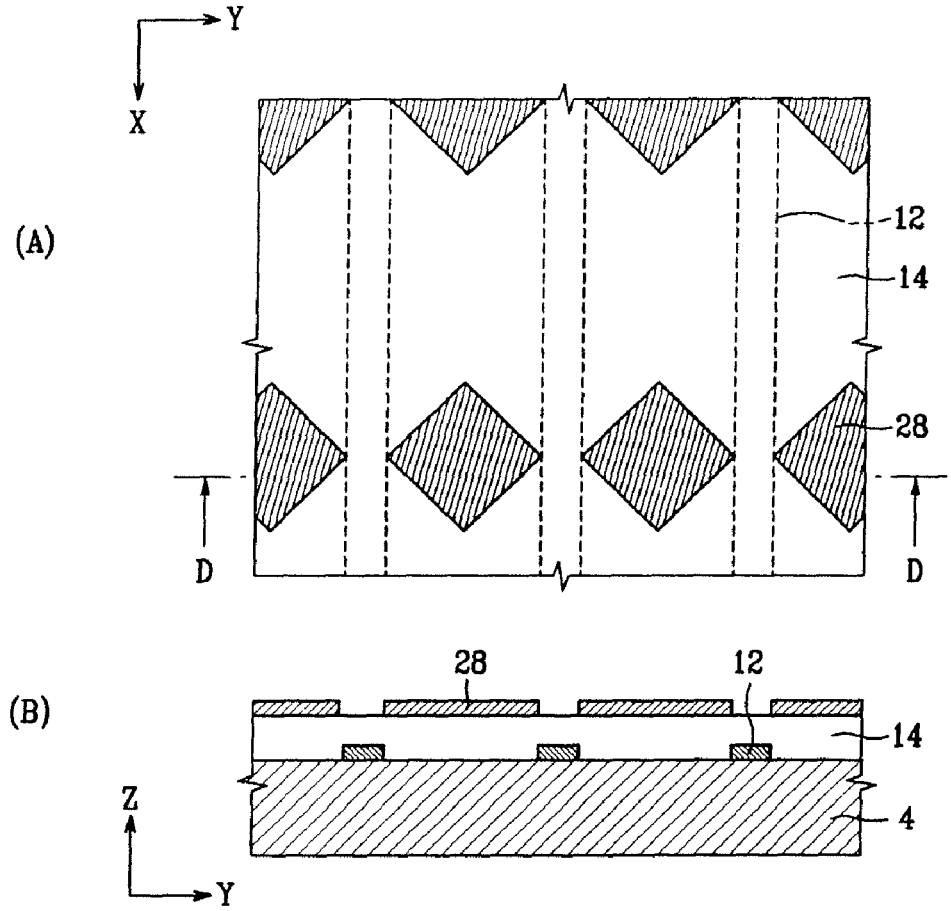

Subsequently, with reference to FIG. 7, black paint is deposited on dielectric layer 14 at areas where non-discharge regions are to be formed to thereby form external light absorbing members 28. As an example, external light absorbing members 28 are formed by first producing a black paste including $MnO_2$, a conventional vehicle, an organic binder, and frit, then this black paste is printed on dielectric layer 14, dried, and fired.

Figure 8:
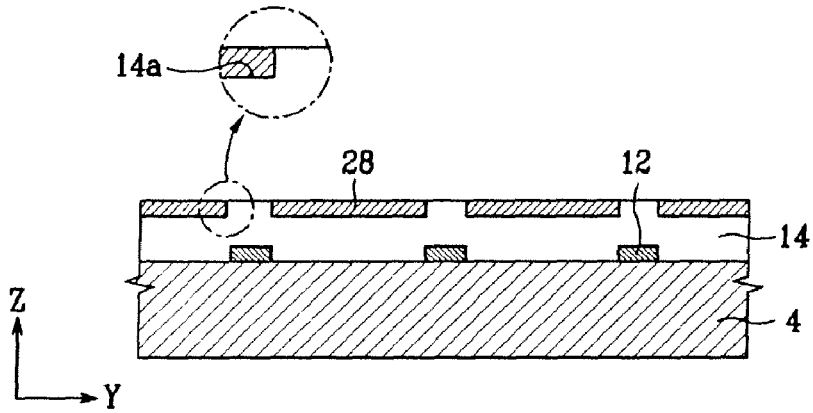

In another embodiment, with reference to FIG. 8, grooves 14*a* are formed in dielectric layer 14 at areas corresponding to where non-discharge regions are to be formed, then black paint is deposited in grooves 14*a* to form external light absorbing members.

Figure 9:
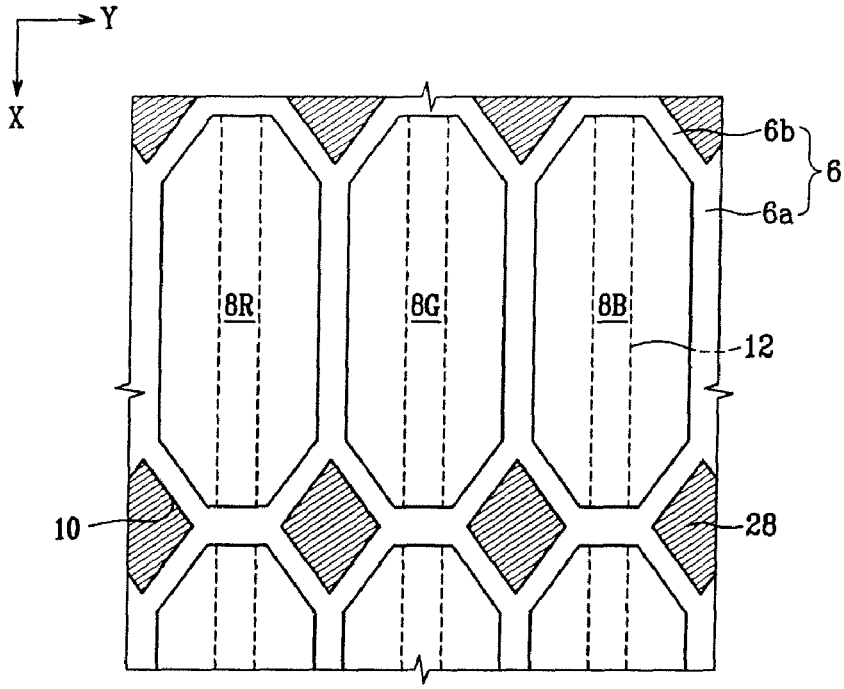

Next, with reference to FIG. 9, barrier ribs 6 are formed on dielectric layer 14 to thereby define non-discharge regions 10 and discharge cells 8R, 8G, 8B. Barrier ribs 6 may be printed into a desired pattern on dielectric layer 14, then dried and fired. Alternatively, barrier rib material may be deposited over the entire dielectric layer 14, after which a sandblasting process is performed to remove select areas and thereby form barrier ribs 6 that define (into a desired pattern) non-discharge regions 10 and discharge cells 8R, 8G, 8B.

Figure 10:
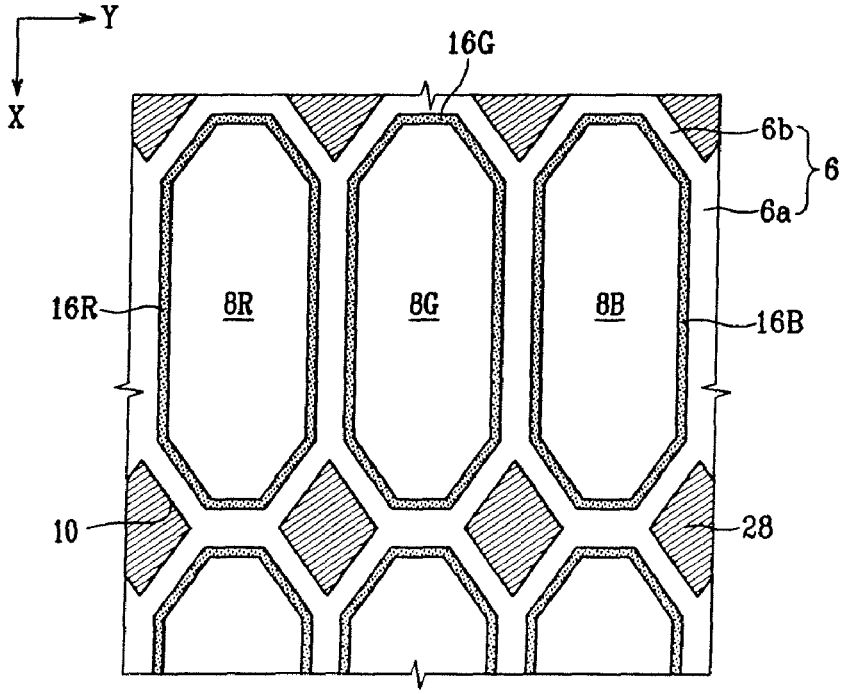

Referring now to FIG. 10, red, green, and blue phosphor material is printed respectively in discharge cells 8R, 8G, 8B, then the phosphor material is dried and fired to form phosphor layers 16R, 16G, 16B. As a result of this and the above processes, phosphor layers 16R, 16G, 16B are positioned respectively in discharge cells 8R, 8G, 8B, and external light absorbing members 28 are positioned on dielectric layer 14 at areas corresponding to non-discharge regions 10, thereby completing the formation of second substrate 4. Second substrate 4 is combined with first substrate 2, on which discharge sustain electrodes, a transparent dielectric layer, and an MgO protection layer are formed, thereby completing the PDP.

In the structure of this embodiment in which barrier ribs 6 are formed following the formation of external light absorbing members 28 on dielectric layer 14 as described above, with the formation of external light absorbing members 28 to a predetermined thickness on dielectric layer 14, areas of barrier ribs 6 on external light absorbing members 28 are higher than other areas of barrier ribs 6 to thereby form a stepped configuration of the same. This aids in the exhaust of the PDP during manufacture.

Figure 11:
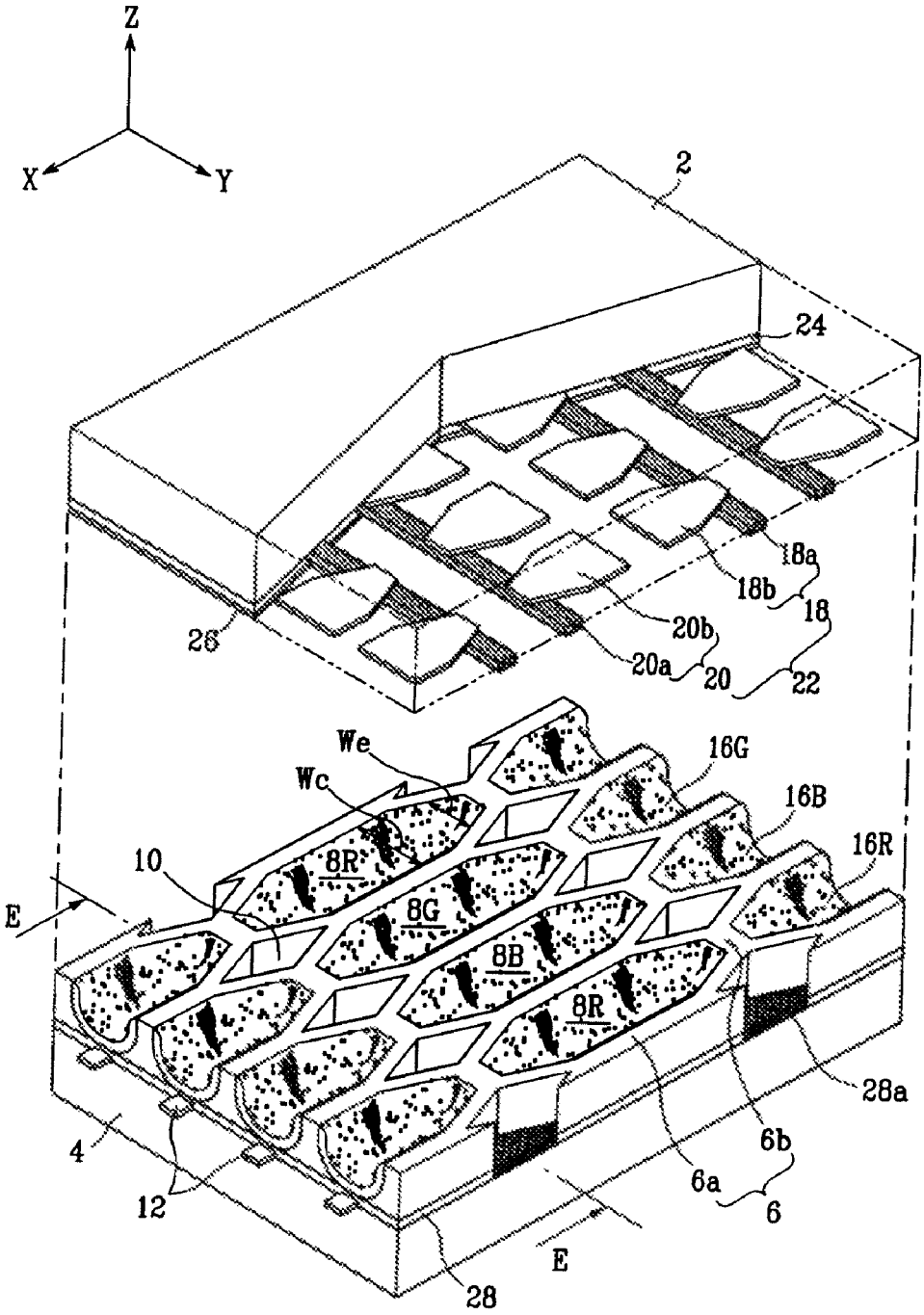
FIG. 11 is a partial exploded perspective view of a plasma display panel according to a second embodiment of the present invention.
Figure 12:
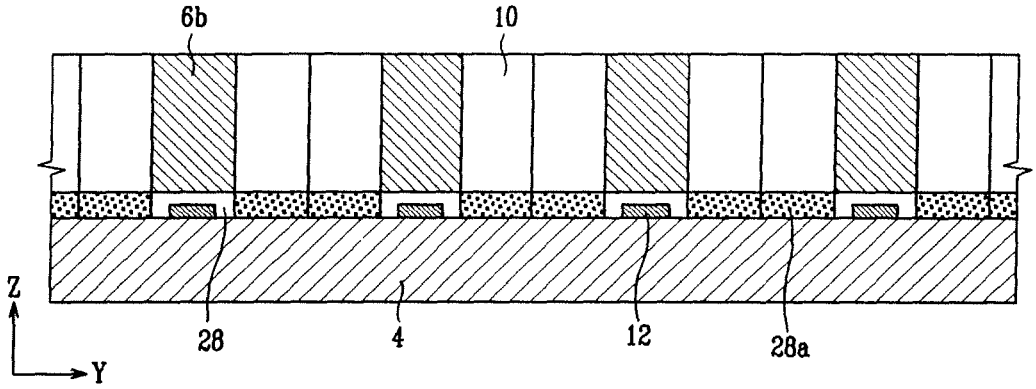
FIG. 12 is a sectional view taken along line E-E of FIG. 11.

FIG. 11 is a partial exploded perspective view of a plasma display panel according to a second embodiment of the present invention, and FIG. 12 is a sectional view taken along line E-E of FIG. 11 in a state where the PDP is assembled. Like reference numerals will be used for elements identical to those of the first embodiment.

Dielectric layer 28 of the second embodiment includes tinted sections 28*a* that have the ability to absorb external light. Tinted sections 28*a* are formed corresponding to the location of non-discharge regions 10. This increases an overall external light absorbing area of the PDP. Tinted sections 28*a* may have one of black coloring or blue coloring, or a mixture of black and blue coloring. As a result of this configuration, areas corresponding to non-discharge regions 10 are darkened.

In one embodiment, the black coloring is realized by one of FeO, $RuO_2$, TiO, $Ti_3O_5$, $Ni_2O_3$, $CrO_2$, $MnO_2$, $Mn_2O_3$, $Mo_2O_3$, and $Fe_3O_4$, or an any combination of these compounds; and the blue coloring is realized by one of $Co_2O_3$, CoO, and $Nd_2O_3$, or any combination of these compounds. In the case where tinted sections 28*a* include blue coloration so that non-discharge regions 10 exhibit a blue color, color purity and color temperature of the screen are improved.

Dielectric layer 28 including tinted sections 28*a* may be manufactured by first forming tinted sections 28*a* at areas corresponding to where non-discharge regions 10 are to be formed, and then coating remaining areas on second substrate 4 with dielectric material.

Figure 13:
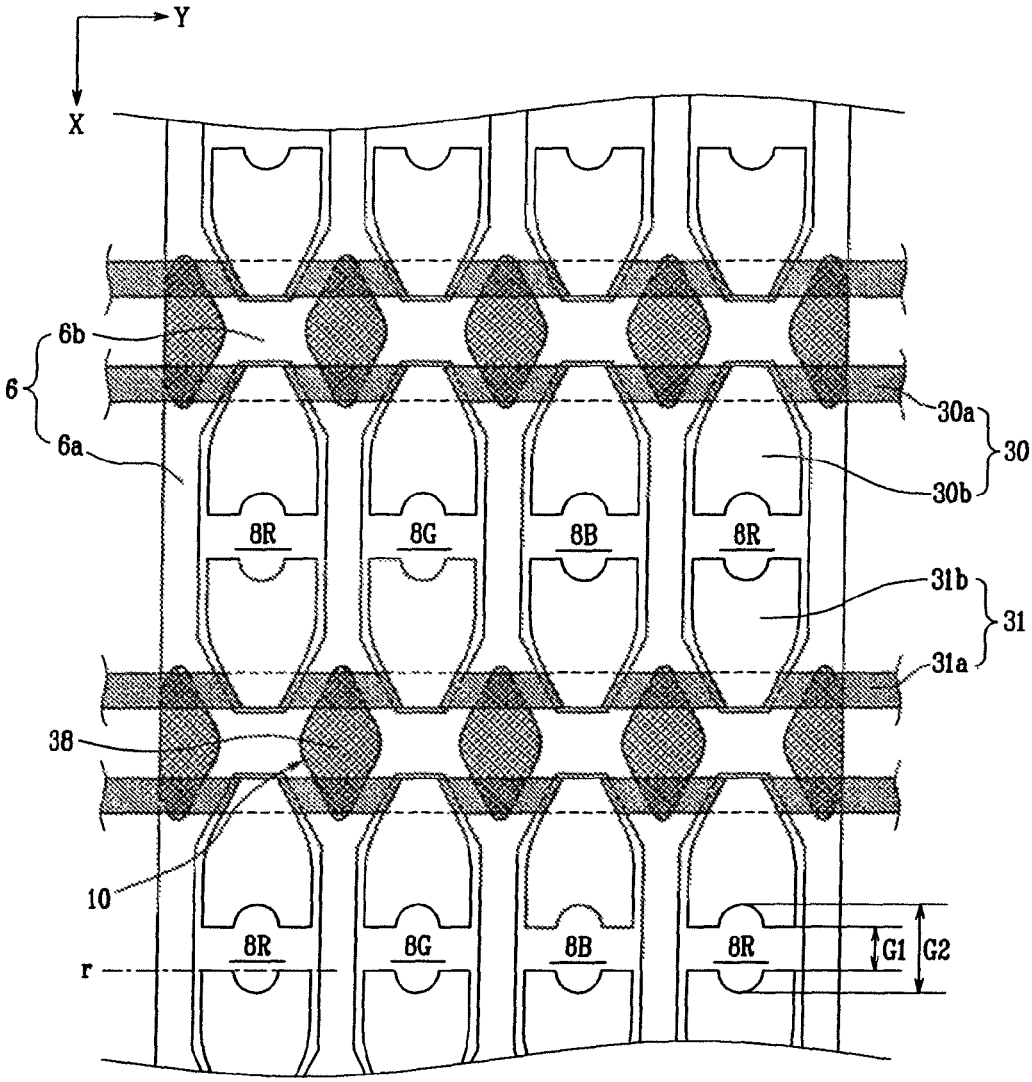
FIG. 13 is a partial plan view of a plasma display panel according to a third embodiment of the present invention.

FIG. 13 is a partial plan view of a plasma display panel according to a third embodiment of the present invention. Like reference numerals will be used for elements identical to those of the first embodiment.

In the PDP according to the third embodiment, discharge sustain electrodes 30, 31 respectively include bus electrodes 30*a*, 31*a* that are formed along a direction substantially perpendicular to a direction address electrodes 12 are and respectively include protrusion electrodes 30*b*, 31*a* that extend from bus electrodes 30*a*, 31*b* into areas corresponding to discharge cells 8R, 8G, 8B.

Distal ends of protrusion electrodes 30*b*, 31*b* are formed such that center areas along direction Y are indented and sections to both sides of the indentations are protruded. Therefore, in each of the discharge cells 8R, 8G, 8B, first discharge gap G1 and second discharge gap G2 of different sizes are formed between opposing protrusion electrodes 30*b*, 31*b*. That is, second discharge gaps G2 (or long gaps) are formed where the indentations of protrusion electrodes 30*b*, 31*b* oppose one another, and first discharge gaps G1 (or short gaps) are formed where the protruded areas to both sides of the indentations of protrusion electrodes 30*b*, 31*b* oppose one another. Accordingly, plasma discharge, which initially occurs at center areas of discharge cells 8R, 8G, 8B, is more efficiently diffused such that overall discharge efficiency is increased.

The distal ends of protrusion electrodes 30*b*, 31*b* may be formed with only indented center areas such that protruded sections are formed to both sides of the indentations, or may be formed with the protrusions to both sides of the indentations extending past a reference straight line r formed along direction Y. Further, protrusion electrodes 30*b*, 31*b* providing the pair of the same positioned within each of the discharge cells 8R, 8G, 8B may be formed as described above, or only one of the pair may be formed with the indentations and protrusions.

External light absorbing members 38 are mounted between second substrate 4 and barrier ribs 6 at areas corresponding to non-discharge regions 10. External light absorbing members 38 may be provided adjacent to dielectric layer 14 formed on second substrate 4 as in the first embodiment, or may be realized by the formation of tinted sections 28*a* at locations corresponding to non-discharge regions 10 to thereby increase the overall external light absorbing area of the PDP as in the second embodiment.

Discharge sustain electrodes 30, 31 are positioned with first and second gaps G1, G2 interposed therebetween to thereby reduce a discharge firing voltage Vf. Accordingly, in the third embodiment, the amount of Xenon contained in the discharge gas may be increased and the discharge firing voltage Vf may be left at the same level. The discharge gas contains 10% or more Xenon. In one embodiment, the discharge gas contains 10~60% Xenon. With the increased Xenon content, vacuum ultraviolet rays may be emitted with a greater intensity to thereby enhance screen brightness.

Figure 14:
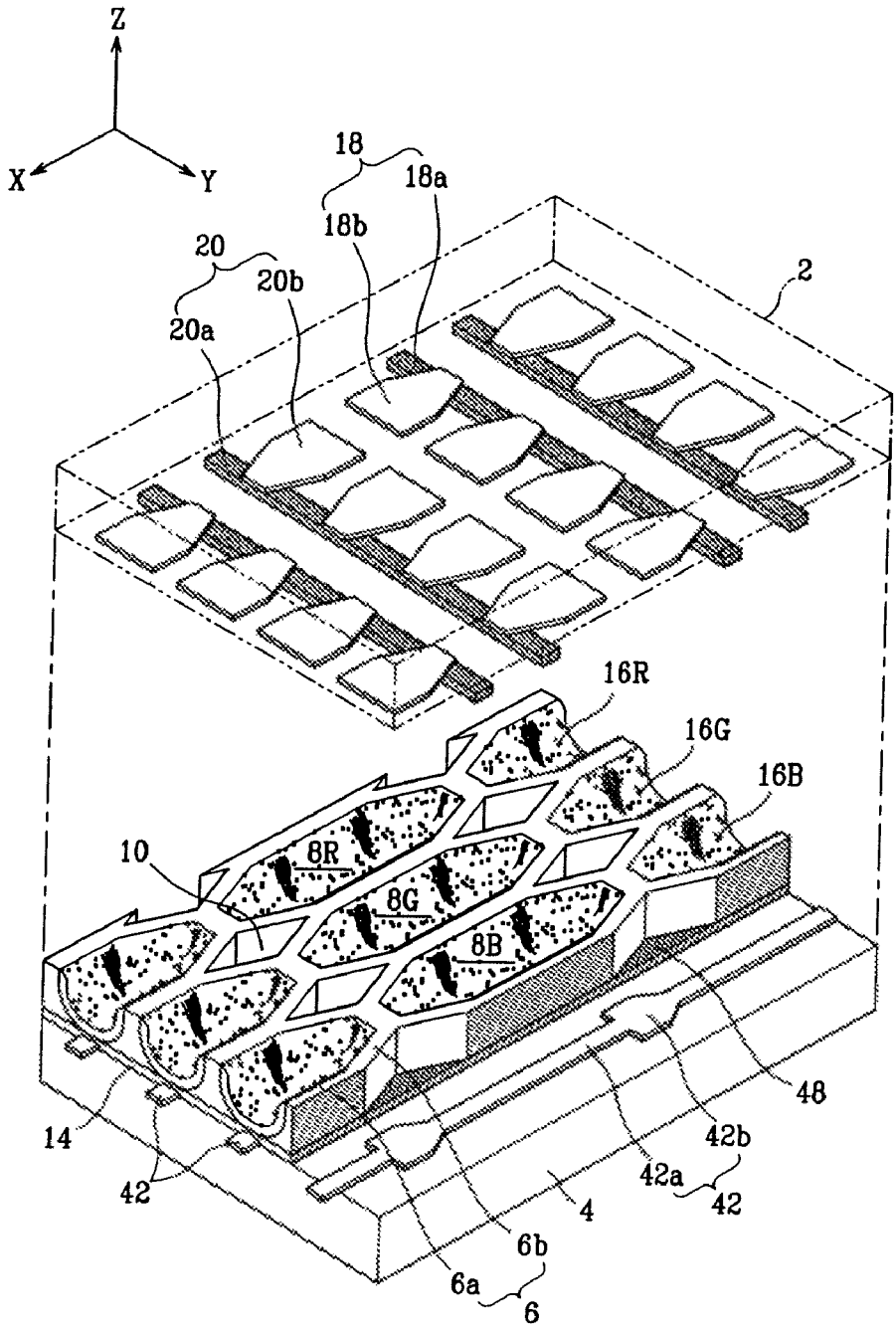
FIG. 14 is a partial exploded perspective view of a plasma display panel according to a fourth embodiment of the present invention.
Figure 15:
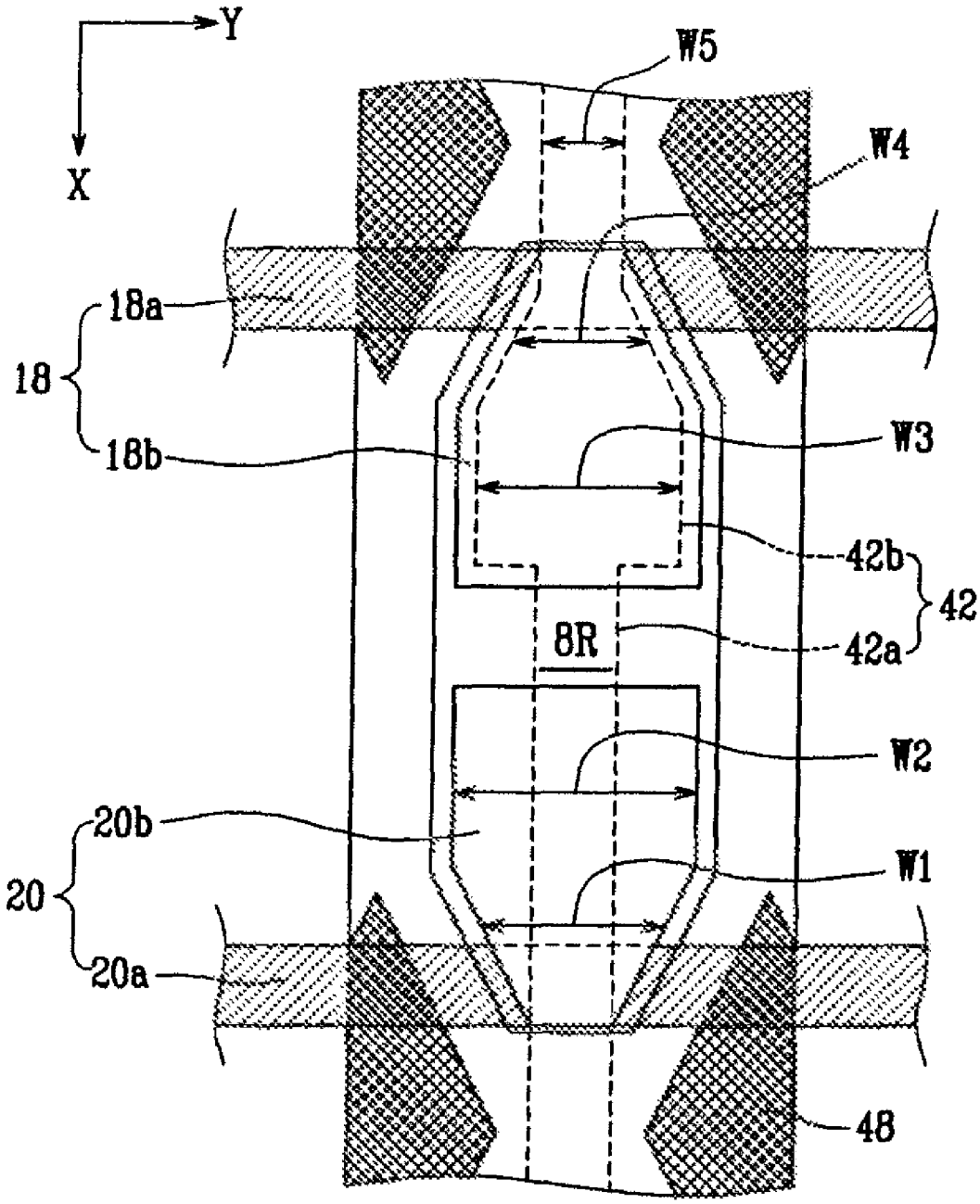
FIG. 15 is an enlarged partial plan view of one discharge cell of FIG. 14.

FIG. 14 is a partial exploded perspective view of a plasma display panel according to a fourth embodiment of the present invention, and FIG. 15 is an enlarged partial plan view of one discharge cell of FIG. 14. Like reference numerals will be used for elements identical to those of previous embodiments.

In the PDP according to the fourth embodiment, barrier ribs 6 define non-discharge regions 10 and discharge cells 8R, 8G, 8B as in the first embodiment. Further, discharge sustain electrodes 18, 20 are formed along a direction (direction Y) substantially perpendicular to the direction address electrodes 42 are formed. Discharge sustain electrodes 18, 20 respectively include bus electrodes 18*a*, 20*a* that extend along the direction address electrodes 42 are formed (direction Y), and protrusion electrodes 18*b*, 20*b* that are extended respectively from bus electrodes 18*a*, 20*a*.

For each row of discharge cells 8R, 8G, 8B along direction Y, bus electrodes 18*a* are extended along one end of discharge cells 8R, 8G, 8B and bus electrodes 20*a* are extended into an opposite end of discharge cells 8R, 8G, 8B. Therefore, each of the discharge cells 8R, 8G, 8B has one of the bus electrodes 18*a* positioned over one end, one of the bus electrodes 20*a* positioned over its other end. Protrusion electrodes 18*b* overlap and protrude from corresponding bus electrode 18*a* into the areas of the discharge cells 8R, 8G, 8B. Also, protrusion electrodes 20*b* overlap and protrude from the corresponding bus electrode 20*a* into the areas of discharge cells 8R, 8G, 8B. Therefore, one protrusion electrode 18*b* and one protrusion electrode 20*b* are formed opposing one another in each area corresponding to each of the discharge cells 8R, 8G, 8B. Discharge sustain electrodes 18 are scan electrodes, and discharge sustain electrodes 20 are display electrodes.

Proximal ends of protrusion electrodes 18*b*, 20*b* (i.e., where protrusion electrodes 18*b*, 20*b* are attached to and extend from bus electrodes 18*a*, 20*a*, respectively) are formed corresponding to the shape of the ends of discharge cells 8R, 8G, 8B. That is, the proximal ends of protrusion electrodes 18*b*, 20*b* reduce in width along direction Y as the distance from the center of discharge cells 8R, 8G, 8B along direction X is increased to thereby correspond to the shape of the ends of discharge cells 8R, 8G, 8B.

In the fourth embodiment, address electrodes 42 include enlarged regions 42*b* formed corresponding to the shape and location of protrusion electrodes 18*b* of scan electrodes 18. Enlarged regions 42*b* increase an area of scan electrodes 13 that oppose address electrodes 42. In more detail, address electrodes 42 include line regions 42*a* formed along direction X, and enlarged regions 42*b* formed at predetermined locations and expanding along direction Y corresponding to the shape of protrusion electrodes 18*b* as described above.

As shown in FIG. 15, when viewed from a front of the PDP, areas of enlarged regions 42*b* of address electrodes 42 opposing distal ends of protrusions 18*b* of scan electrodes 18 are substantially rectangular having width W3, and areas of enlarged regions 42*b* of address electrodes 42 opposing proximal ends of protrusions 18*b* of scan electrodes 18 are substantially in the shape of a trapezoid (with its base removed) having width W4 that is less than width W3 and decreases gradually as bus electrodes 18*a* are neared. With width W5 corresponding to the width of line regions 42*a* of address electrodes 42, the following inequalities are maintained: W3>W5 and W4>W5.

With the formation of enlarged regions 42*b* at areas opposing scan electrodes 18 of address electrodes 42 as described above, address discharge is activated when an address voltage is applied between address electrodes 42 and scan electrodes 18, and the influence of display electrodes 20 is not received. Accordingly, in the PDP of the fourth embodiment, address discharge is stabilized such that crosstalk is prevented during address discharge and sustain discharge, and an address voltage margin is increased.

External light absorbing members 48 are mounted between second substrate 4 and barrier ribs 6 at areas corresponding to non-discharge regions 10. External light absorbing members 38 may be provided adjacent to dielectric layer 14 formed on second substrate 4 as in the first embodiment, or may be realized by the formation of tinted sections 28*a* at locations corresponding to non-discharge regions 10 to thereby increase the overall external light absorbing area of the PDP as in the second embodiment.

Figure 16:
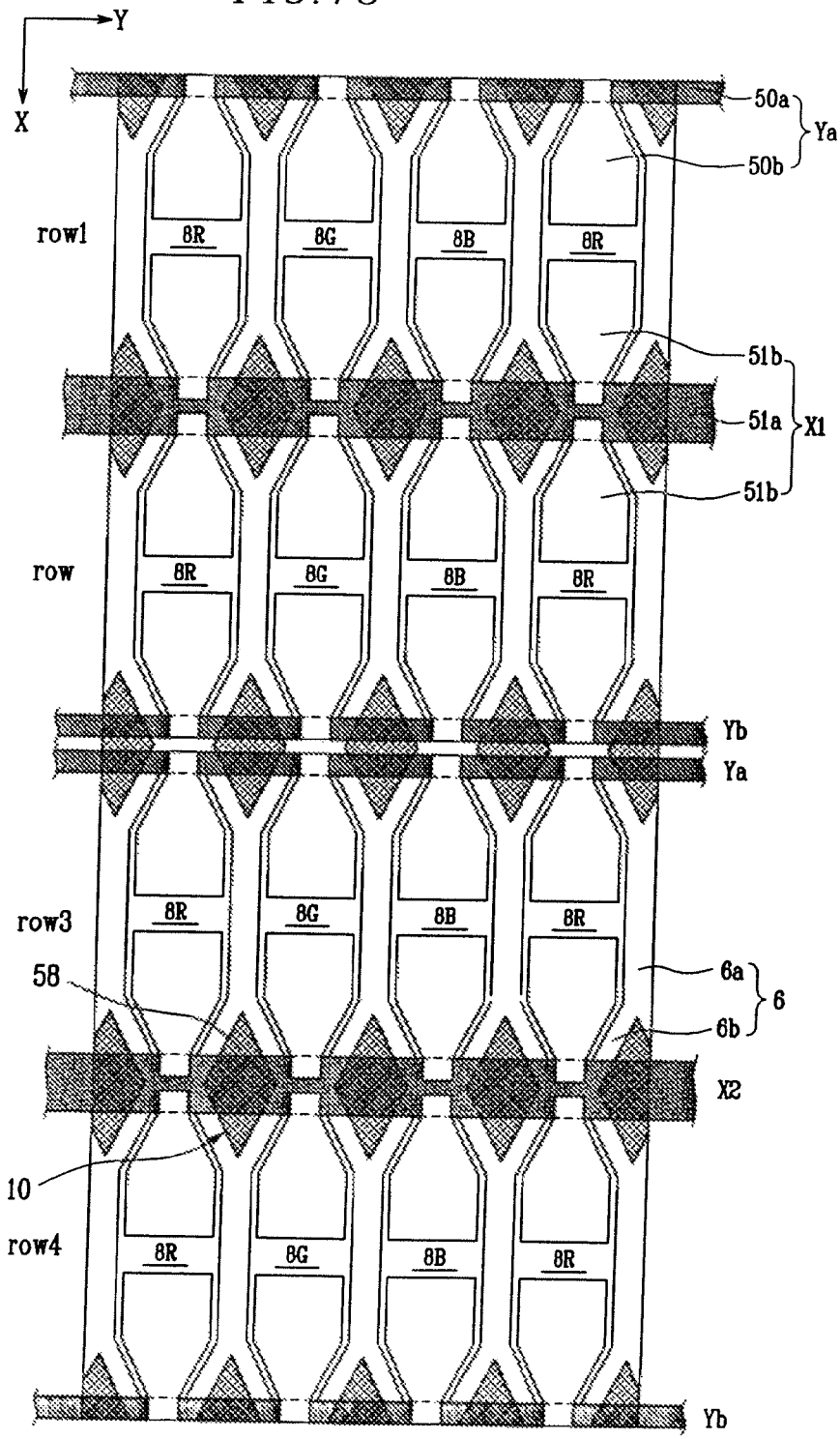
FIG. 16 is a partial plan view of a plasma display panel according to a fifth embodiment of the present invention.

FIG. 16 is a partial plan view of a plasma display panel according to a fifth embodiment of the present invention. Like reference numerals will be used for elements identical to those of previous embodiments.

In the PDP according to the fifth embodiment, barrier ribs 6 define non-discharge regions 10 and discharge cells 8R, 8G, 8B as in the first embodiment. Further, discharge sustain electrodes are formed along a direction (direction Y) substantially perpendicular to the direction address electrodes 42 are formed. The discharge sustain electrodes include scan electrodes (Ya, Yb) and display electrodes Xn (where n=1, 2, 3, . . . ).

Scan electrodes (Ya, Yb) and display electrodes Xn include bus electrodes 50*a*, 51*a*, respectively, that extend along the direction substantially perpendicular to the direction address electrodes 42 are formed (direction Y), and protrusion electrodes 50*b*, 51*b*, respectively, that are extended respectively from bus electrodes 50*a*, 51*a* such that a pair of protrusion electrodes 50*b*, 51*b* oppose one another in each discharge cell 8R, 8G, 8B. Scan electrodes (Ya, Yb) act together with address electrodes 42 to select discharge cells 8R, 8G, 8B and display electrodes Xn act to initialize discharge and generate sustain discharge between scan electrodes (Ya, Yb).

Letting the term "rows" be used to describe lines of discharge cells 8R, 8G, 8B adjacent along direction Y, bus electrodes 51*a* of display electrodes Xn are provided such that one of the bus electrodes 51*a* is formed overlapping ends of discharge cells 8R, 8G, 8B in every other pair of rows adjacent along direction X. Further, bus electrodes 50*a* of scan electrodes (Ya, Yb) are provided such that one bus electrode 50*a* of scan electrodes Ya and one bus electrode 50*a* of scan electrodes Yb are formed overlapping ends of discharge cells 8R, 8G, 8B in every other pair of rows adjacent along direction X. Along this direction X, scan electrodes (Ya, Yb) and display electrodes Xn are provided in an overall pattern of Ya-X1-Yb-Ya-X2-Yb-Ya-X3-Yb- . . . -Ya-Xn-Yb. With this configuration, display electrodes Xn are able to participate in the discharge operation of all discharge cells 8R, 8G, 8B.

Further, bus electrodes 50*a*, 51*a* respectively of scan electrodes (Ya, Yb) and display electrodes Xn are positioned also outside the region of discharge cells 8R, 8G, 8B. This prevents a reduction in the aperture ratio by bus electrodes 50*a*, 51*a* such that a high degree of brightness is maintained. In addition, bus electrodes 51*a* of display electrodes Xn are formed covering a greater area along direction X than pairs of bus electrodes 50*a* of scan electrodes (Ya, Yb). This is because bus electrodes 51*a* of display electrodes Xn absorb outside light to thereby improve contrast.

External light absorbing members 58 are mounted between second substrate 4 and barrier ribs 6 at areas corresponding to non-discharge regions 10. External light absorbing members 58 may be provided adjacent to dielectric layer 14 formed on second substrate 4 as in the first embodiment, or may be realized by the formation of tinted sections 28*a* at locations corresponding to non-discharge regions 10 to thereby increase the overall external light absorbing area of the PDP as in the second embodiment.

Figure 17:
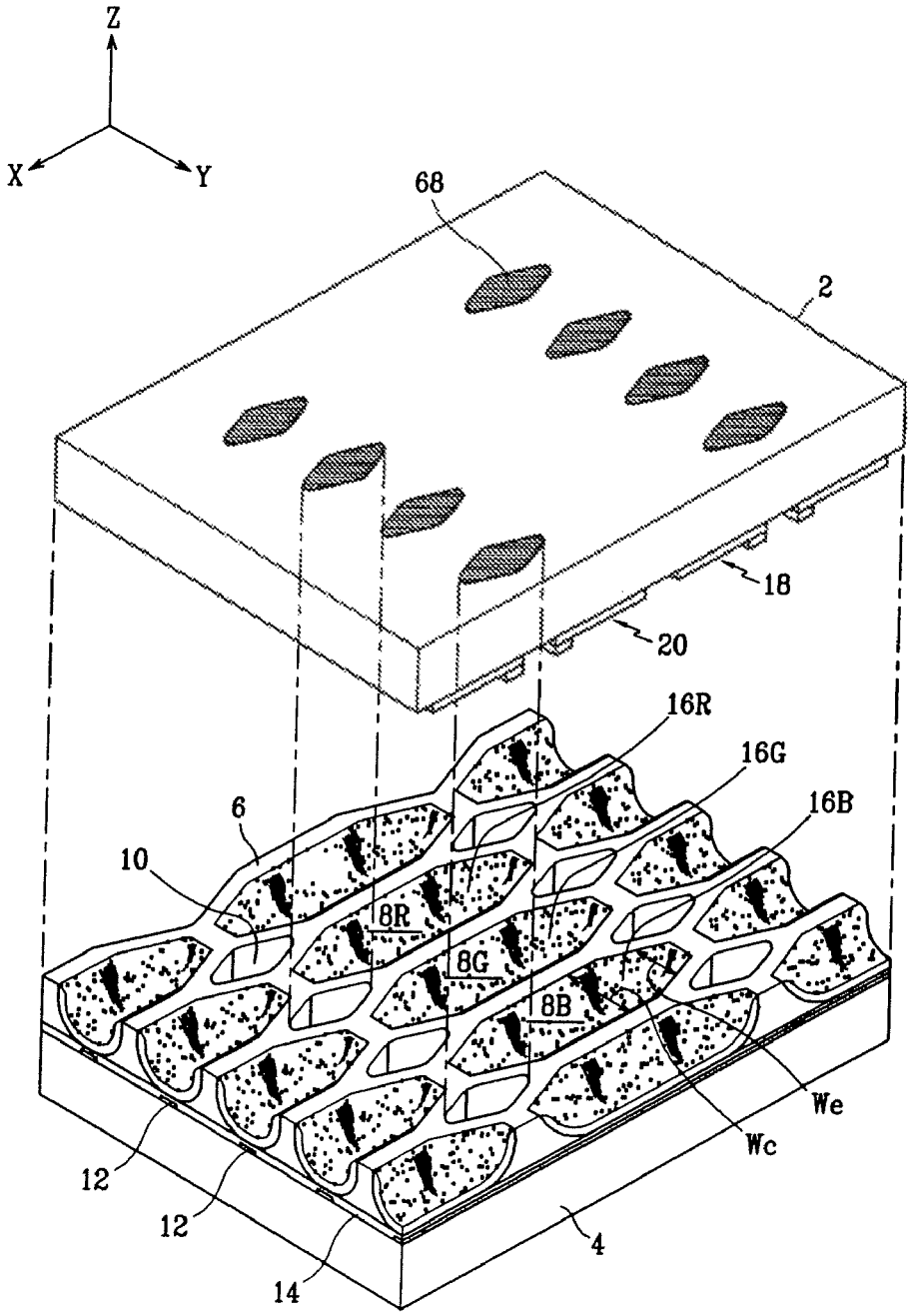
FIG. 17 is a partial exploded perspective view of a plasma display panel according to a sixth embodiment of the present invention.
Figure 18:
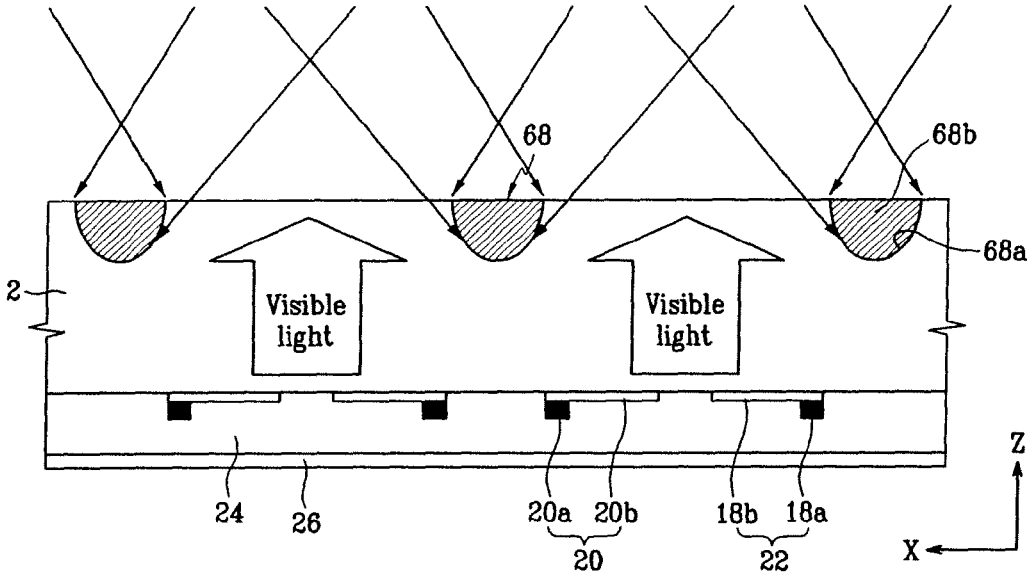
FIG. 18 is a sectional view of a front substrate of the plasma display panel of FIG. 17.

FIG. 17 is a partial exploded perspective view of a plasma display panel according to a sixth embodiment of the present invention, and FIG. 18 is a sectional view of a front substrate of the plasma display panel of FIG. 17. Like reference numerals will be used for elements identical to those of previous embodiments.

In the sixth embodiment, the basic configuration of the first embodiment is used. That is, first substrate 2 and second substrate 4 are provided opposing one another with a predetermined gap therebetween, and barrier ribs 6 define non-discharge regions 10 and discharge cells 8R, 8G, 8B. Further, external light absorbing members 68 are formed on an outer surface of first substrate 2 at areas corresponding to discharge regions 10. External light absorbing members 68 prevent the reflection of external light.

Barrier ribs 6 define discharge cells 8R, 8G, 8B in a direction of address electrodes 12 (direction X), and in a direction substantially perpendicular to the direction address electrodes 12 are formed (direction Y). Discharge cells 8R, 8G, 8B are formed in a manner to optimize gas diffusion. In particular, each of the discharge cells 8R, 8G, 8B is formed with ends that reduce in width along direction Y as a distance from a center of each of the discharge cells 8R, 8G, 8B is increased in the direction address electrodes 12 are provided (direction X). Non-discharge regions 10 defined by barrier ribs 6 are formed in areas encompassed by discharge cell abscissas H and ordinates V that pass through centers of each of the discharge cells 8R, 8G, 8B, and that are respectively aligned with direction Y and direction X.

Discharge sustain electrodes 18, 20 are formed in a striped pattern and respectively include bus electrodes 18*a*, 20*a* that extend along the direction address electrodes 42 are formed (direction Y), and protrusion electrodes 18*b*, 20*b* that are extended respectively from bus electrodes 18*a*, 20*a*. For each row of discharge cells 8R, 8G, 8B along direction Y, bus electrodes 18*a* are extended along one end of discharge cells 8R, 8G, 8B and bus electrodes 20*a* are extended into an opposite end of discharge cells 8R, 8G, 8B. Therefore, each of the discharge cells 8R, 8G, 8B has one of the bus electrodes 18*a* positioned over one end, and one of the bus electrodes 20*a* positioned over its other end. Protrusion electrodes 18*b* overlap and protrude from corresponding bus electrode 18*a* into the areas of the discharge cells 8R, 8G, 8B. Also, protrusion electrodes 20*b* overlap and protrude from the corresponding bus electrode 20*a* into the areas of discharge cells 8R, 8G, 8B. Therefore, one protrusion electrode 18*b* and one protrusion electrode 20*b* are formed opposing one another in each area corresponding to each of the discharge cells 8R, 8G, 8B.

Proximal ends of protrusion electrodes 18*b*, 20*b* (i.e., where protrusion electrodes 18*b*, 20*b* are attached to and extend from bus electrodes 18*a*, 20*a*, respectively) are formed corresponding to the shape of the ends of discharge cells 8R, 8G, 8B. That is, the proximal ends of protrusion electrodes 18*b*, 20*b* reduce in width along direction Y as the distance from the center of discharge cells 8R, 8G, 8B along direction X is increased to thereby correspond to the shape of the ends of discharge cells 8R, 8G, 8B.

As described above, external light absorbing members 68 are formed on an outer surface of first substrate 2 at areas corresponding to discharge regions 10. As a result of being positioned over discharge regions, external light absorbing members 68 do not shield visible light used for display generated by the illumination of phosphor layers 16R, 16G, 16B, and perform their function of absorbing part of the external light irradiated onto the PDP to thereby enhance the blocking of external light reflection.

External light absorbing members 68, with reference to FIG. 18, may be realized by forming grooves 68*a* of a predetermined depth in the outer surface of first substrate 2 and at areas corresponding to non-discharge regions 10, and by filling grooves 68*a* with a black light blocking material 68*b*. The light blocking material 68*b* may be made of a material that is black such as the material used for light shielding films in conventional PDPs.

Grooves 68*a* may be formed in the outer surface of first substrate 2 using conventional sandblasting or etching techniques. Grooves 68*a* are formed to a depth of 100-300 μm, that is, a range that cause cracks to be formed in first substrate 2. Further, external light absorbing members 68 are formed having a planar shape (in the X-Y plane) identical to that of non-discharge regions. However, the present invention is not limited to such a configuration and other shapes may be employed.

External light absorbing members 68 absorb external light irradiated onto the PDP (see the arrows in FIG. 18) to thereby prevent external light from passing through to discharge cells 8R, 8G, 8B. Therefore, external light absorbing members 68 minimize the reflection of external light from the outside of first substrate 2 to thereby improve bright room contrast, and effectively prevent shielding of parts of the screen by external light reflection. Further, external light absorbing members 68 are positioned to the outside of first substrate 2 and not on an inner surface of the same such that they do not affect discharge cells 8R, 8G, 8B and thereby prevent abnormal discharge in discharge cells 8R, 8G, 8B.

The sixth embodiment may provide these advantages while selectively applying the features of the third through fifth embodiments.

Figure 19:
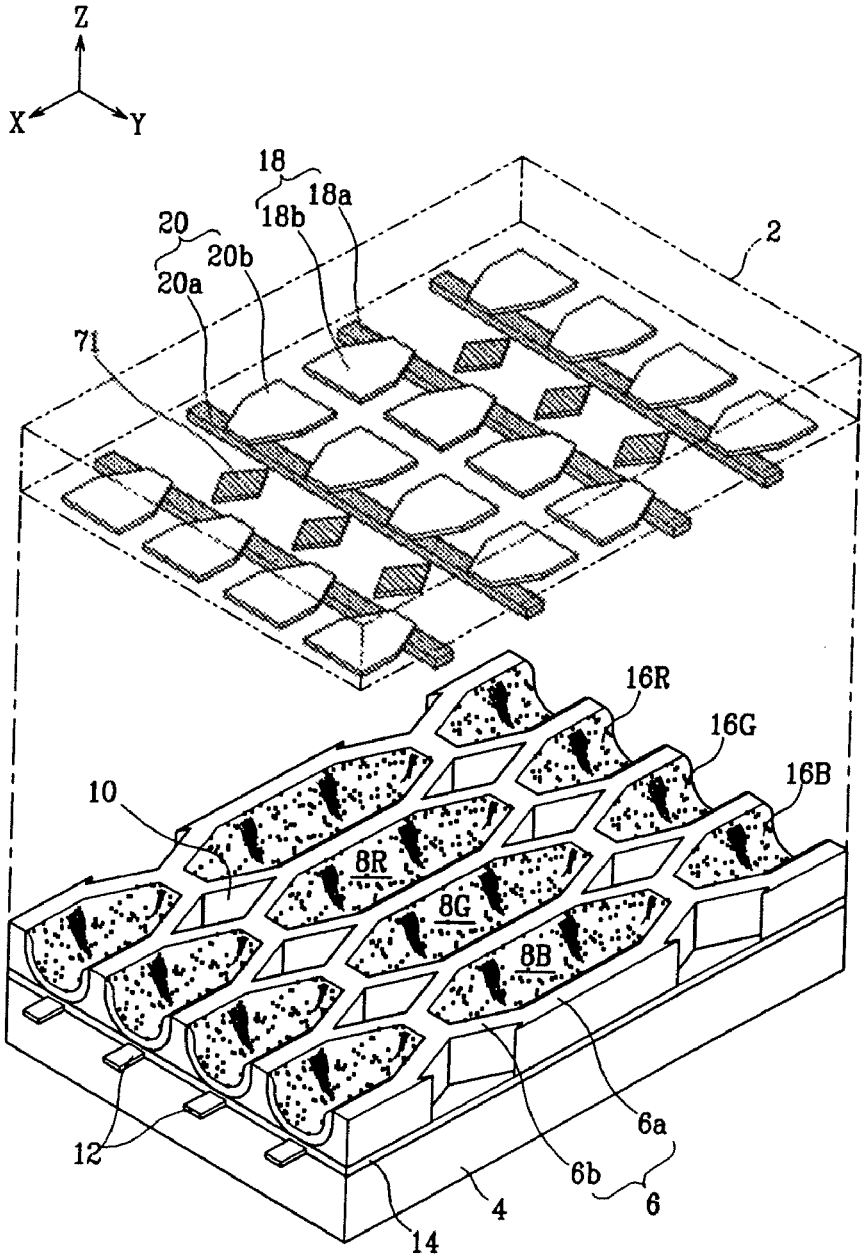
FIG. 19 is a partial exploded perspective view of a plasma display panel according to a seventh embodiment of the present invention.
Figure 20:
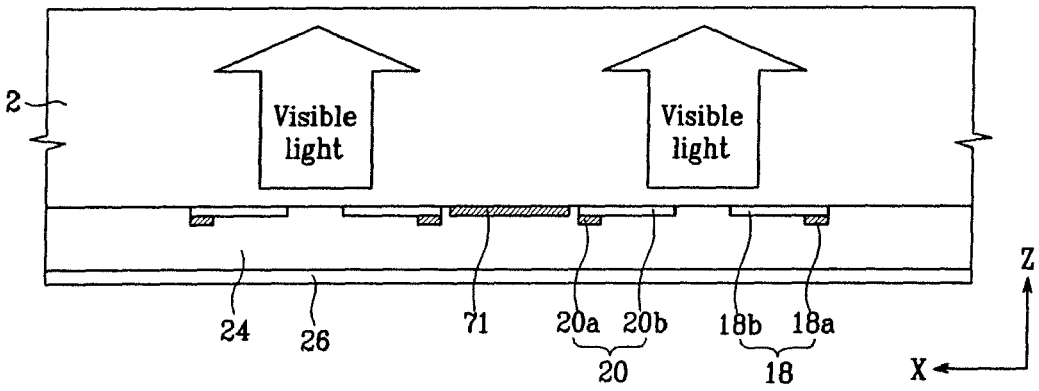
FIG. 20 is a sectional view of a front substrate of the plasma display panel of FIG. 19.

FIG. 19 is a partial exploded perspective view of a plasma display panel according to a seventh embodiment of the present invention, and FIG. 20 is a sectional view of a front substrate of the plasma display panel of FIG. 19. Like reference numerals will be used for elements identical to those of previous embodiments.

In the seventh embodiment, the basic configuration of the first embodiment is used. That is, first substrate 2 and second substrate 4 are provided opposing one another with a predetermined gap therebetween, barrier ribs 6 define non-discharge regions 10 and discharge cells 8R, 8G, 8B. Barrier ribs 6 define discharge cells 8R, 8G, 8B in a direction of address electrodes 12 (direction X), and in a direction substantially perpendicular to the direction address electrodes 12 are formed (direction Y). Discharge cells 8R, 8G, 8B are formed in a manner to optimize gas diffusion. In particular, each of the discharge cells 8R, 8G, 8B is formed with ends that reduce in width along direction Y as a distance from a center of each of the discharge cells 8R, 8G, 8B is increased in the direction address electrodes 12 are provided (direction X). Non-discharge regions 10 defined by barrier ribs 6 are formed in areas encompassed by discharge cell abscissas H and ordinates V that pass through centers of each of the discharge cells 8R, 8G, 8B, and that are respectively aligned with direction Y and direction X.

Discharge sustain electrodes 18, 20 are formed in a striped pattern and respectively include bus electrodes 18*a*, 20*a* that extend perpendicular to the direction address electrodes 12 are formed, and protrusion electrodes 18*b*, 20*b* that are extended respectively from bus electrodes 18*a*, 20*a*. For each row of discharge cells 8R, 8G, 8B along direction Y, bus electrodes 18*a* are extended along one end of discharge cells 8R, 8G, 8B and bus electrodes 20*a* are extended into an opposite end of discharge cells 8R, 8G, 8B. Therefore, each of the discharge cells 8R, 8G, 8B has one of the bus electrodes 18*a* positioned over one end, and one of the bus electrodes 20*a* positioned over its other end. Protrusion electrodes 18*b* overlap and protrude from corresponding bus electrode 18*a* into the areas of the discharge cells 8R, 8G, 8B. Also, protrusion electrodes 20*b* overlap and protrude from the corresponding bus electrode 20*a* into the areas of discharge cells 8R, 8G, 8B. Therefore, one protrusion electrode 18*b* and one protrusion electrode 20*b* are formed opposing one another in each area corresponding to each of the discharge cells 8R, 8G, 8B.

Proximal ends of protrusion electrodes 18*b*, 20*b* (i.e., where protrusion electrodes 18*b*, 20*b* are attached to and extend from bus electrodes 18*a*, 20*a*, respectively) are formed corresponding to the shape of the ends of discharge cells 8R, 8G, 8B. That is, the proximal ends of protrusion electrodes 18*b*, 20*b* reduce in width along direction Y as the distance from the center of discharge cells 8R, 8G, 8B along direction X is increased to thereby correspond to the shape of the ends of discharge cells 8R, 8G, 8B.

Color compensating members 71 including pigmentation of the color having the lowest brightness ratio among the red, green, and blue phosphors forming phosphor layers 16R, 16G, 16B are formed on an inner surface of first substrate 2 and at areas corresponding to the formation of non-discharge regions 10. As shown clearly in FIG. 10, color compensating members 71 are films having substantially the same shape as non-discharge regions 10.

In more detail, in the case where the brightness ratio of red is the lowest among red, green, and blue phosphors, color compensating members 71 are realized through films deposited with red paint to thereby compensate for this color. Other colors may be used if it is found that they have the lowest brightness ratio.

Accordingly, in the PDP of the seventh embodiment, color purity and color temperature are improved by color compensating members 71. Also, white brightness is enhanced without the use of gamma compensation. In addition, since color compensating members 71 absorb part of the light passing through first substrate 2 from the outside, the dark/light ratio of the screen is improved.

In one embodiment, color compensating members 71 are formed occupying 50% or less of the total area of first substrate 2. Further, color compensating members 71 have a color compensation ratio (i.e., color temperature increasing ratio) that is less than the combined transmissivity of first substrate 2, protrusion electrodes 18*b*, 20*b*, transparent dielectric layer 24, and MgO protection layer 26, but larger than a light transmissivity of conventional black stripes.

Eighth, ninth, and tenth embodiments of the present invention will now be described with reference to FIGS. 21, 22, and 23, respectively.

Figure 21:
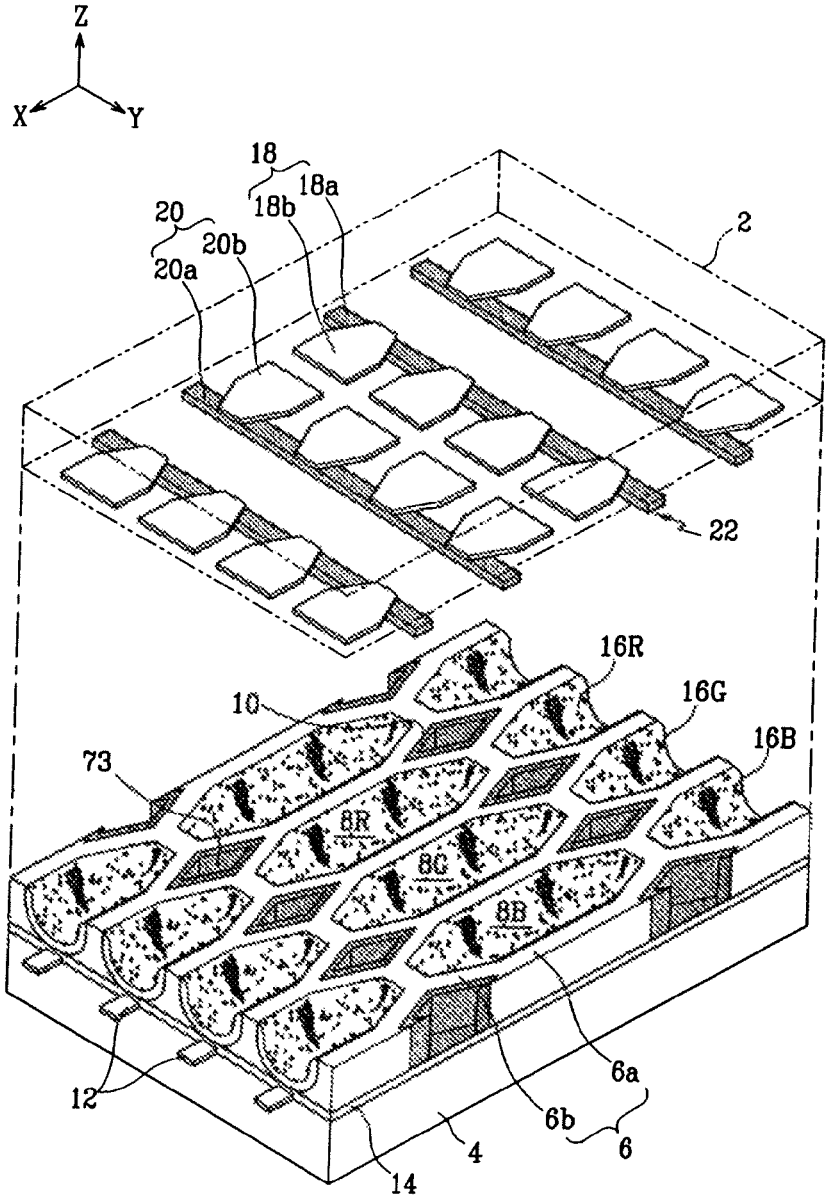
FIG. 21 is a partial exploded perspective view of a plasma display panel according to an eighth embodiment of the present invention.

FIG. 21 is a partial exploded perspective view of a plasma display panel according to an eighth embodiment of the present invention. Using the basic configurations of the above embodiments, color compensating members 73 are formed within non-discharge regions 10, rather than on the inner surface of first substrate 2. That is, color compensating members 73 are formed along inner surface of barrier ribs 6 defining non-discharge regions 10, as well on exposed areas of dielectric layer 14 within non-discharge regions 10. The color of color compensating members 73 is selected based on whichever of the red, green, and blue phosphors have the lowest brightness ratio.

Figure 22:
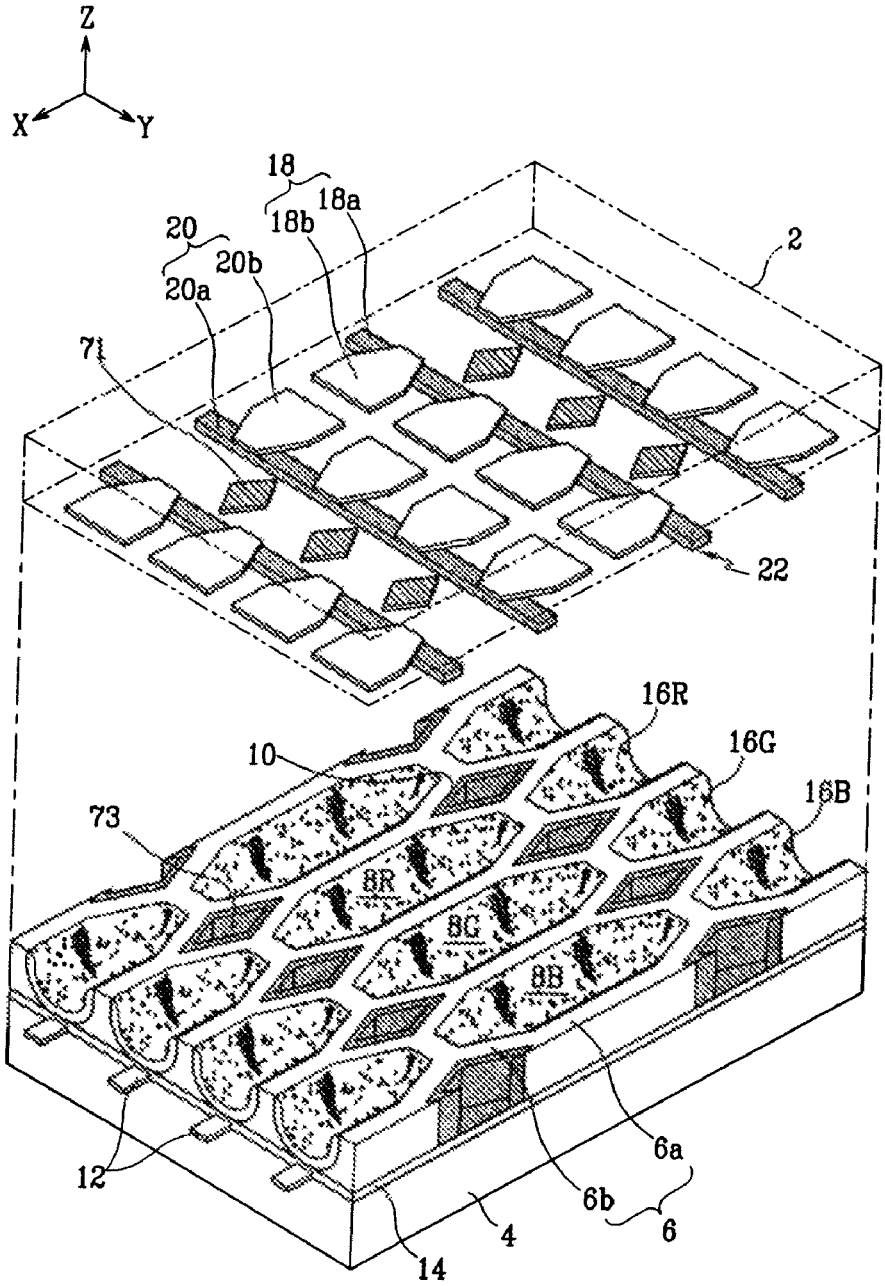
FIG. 22 is a partial exploded perspective view of a plasma display panel according to a ninth embodiment of the present invention.

FIG. 22 is a partial exploded perspective view of a plasma display panel according to a ninth embodiment of the present invention. Using the basic configurations of the above embodiments, both color compensating members 71 as described with reference to the seventh embodiment, and color compensating members 73 as described with reference to the eighth embodiment are provided in the PDP of this embodiment. In particular, color compensating members 71 are formed on the inner surface of first substrate 2, and color compensating members 73 are formed within non-discharge regions 10.

Figure 23:
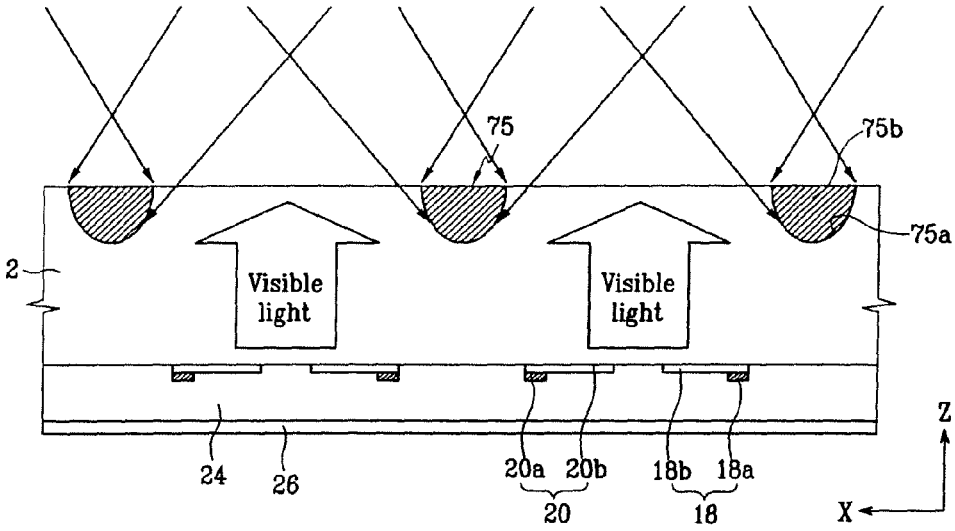
FIG. 23 is a sectional view of a front substrate of a plasma display panel according to a tenth embodiment of the present invention.
Figure 24:
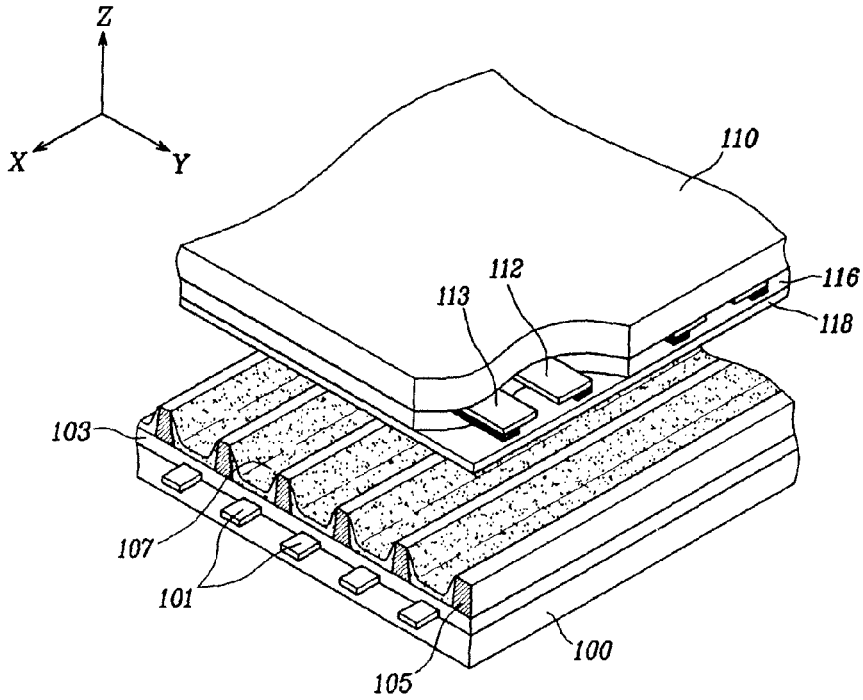
FIG. 24(Prior Art)
FIG. 24 is a partial exploded perspective view of a conventional plasma display panel.

FIG. 23 is a sectional view of a front substrate of a plasma display panel according to a tenth embodiment of the present invention. In this embodiment, color compensating members 75 are formed to the outside surface of first substrate 2 (rather on the inner surface of the same) at areas corresponding to the positioning of non-discharge regions 10. Color compensating members 75 may be realized by forming grooves 75*a* of a predetermined depth in the outer surface of first substrate 2 and at areas corresponding to discharge regions 10, and by filling grooves 75*a* with a color layer 75*b*.

Grooves 75*a* may be formed in the outer surface of first substrate 2 using conventional sandblasting or etching techniques. Grooves 75*a* are formed to a depth of 100-300 μm, that is, a range that cause cracks to be formed in first substrate 2.

In the eighth and ninth embodiments, color compensating members 71 are shown having the same planar configuration (along the X-Y plane) as non-discharge regions 10, but are not limited only to this configuration. Further, in the PDP of the seventh through tenth embodiments, features of the third through fifth embodiments may be applied while maintaining the particular features/advantages described.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A plasma display panel, comprising:

a first substrate and a second substrate opposing one another with a gap therebetween;

address electrodes on the second substrate;

barrier ribs between the first substrate and the second substrate, the barrier ribs defining a plurality of discharge cells and a plurality of non-discharge regions;

a red phosphor layer, a green phosphor layer, and a blue phosphor layer within respective discharge cells; and discharge sustain electrodes on the first substrate in a direction intersecting the address electrodes, wherein the non-discharge regions are in areas encompassed by discharge cell abscissas through centers of adjacent discharge cells and discharge cell ordinates through centers of adjacent discharge cells, the non-discharge regions being at least as large as distal ends of the barrier ribs forming the discharge cells, wherein color compensating members have a coloration corresponding to a color having a lowest brightness ratio among the red phosphor layer, the green phosphor layer and the blue phosphor layer, the color compensating members being at areas corresponding to locations of the non-discharge regions, between the first substrate and the second substrate.

2. The plasma display panel of claim 1, wherein the color compensating members include one coloration selected from the group of red coloration, green coloration, and blue coloration.

3. The plasma display panel of claim 1, wherein the color compensating members are on an inner surface of the first substrate.

4. The plasma display panel of claim 1, wherein the color compensating members are in the non-discharge regions.

5. The plasma display panel of claim 4, wherein the barrier ribs defining adjacent discharge cells form the non-discharge regions into cell structures, the color compensating members being within the cells forming the non-discharge regions.

6. The plasma display panel of claim 1, wherein the color compensating members are on an inner surface of the first substrate and in the non-discharge regions.

7. The plasma display panel of claim 1, wherein the color compensating members are on an outer surface of the first substrate.

8. The plasma display panel of claim 7, wherein the color compensating members comprise grooves having a depth in an outer surface of the first substrate, and color layers in the grooves.

9. The plasma display panel of claim 8, wherein the depth is 100-300 μm.

10. The plasma display panel of claim 1, wherein the color compensating members have a planar shape similar to a planar shape of the non-discharge regions.

11. The plasma display panel of claim 1, wherein the color compensating members have a combined area 50% or less of an area of the first substrate.

12. The plasma display panel of claim 1, wherein ends of the discharge cells gradually decrease in width along the direction of the discharge sustain electrodes as a distance from a center of the discharge cells is increased along a direction of the address electrodes.

13. The plasma display panel of claim 1, wherein each of the discharge sustain electrodes includes bus electrodes extending such that a pair of the bus electrodes is provided for each of the discharge cells, and protrusion electrodes extending from each of the bus electrodes such that a pair of opposing protrusion electrodes is within areas corresponding to each discharge cell, wherein proximal ends of the protrusion electrodes decrease in width along the direction of the discharge sustain electrodes as a distance from a center of the discharge cells is increased along a direction of the address electrodes, wherein distal ends of the protrusion electrodes connected to and extended from the bus electrodes have an indentation, and a first discharge gap and a second discharge gap of different sizes between distal ends of opposing protrusion electrodes.

14. The plasma display panel of claim 13, wherein the discharge cells include discharge gas containing 10% or more Xenon.

15. The plasma display panel of claim 13, wherein the discharge cells include discharge gas containing 10-60% Xenon.

16. The plasma display panel of claim 1, wherein the discharge sustain electrodes include scan electrodes and display electrodes such that one scan electrode and one display electrode correspond to each row of the discharge cells, the scan electrodes and the display electrodes including protrusion electrodes extending into the discharge cells while opposing one another, wherein the protrusion electrodes have a width of protrusion electrode proximal ends smaller than a width of protrusion electrode distal ends, wherein the address electrodes include line regions formed along a direction the address electrodes are formed, enlarged regions expanding along a direction substantially perpendicular to a direction of the line regions to correspond to the shape of protrusion electrodes of the scan electrodes.

17. The plasma display panel of claim 1, wherein the discharge sustain electrodes include scan electrodes and display electrodes such that one scan electrode and one display electrode correspond to each row of the discharge cells, wherein each of the scan electrodes and display electrodes includes bus electrodes extended along a direction substantially perpendicular to a direction of the address electrodes, protrusion electrodes extending into the discharge cells from the bus electrodes such that the protrusion electrodes of the scan electrodes oppose the protrusion electrodes of the display electrodes, wherein one of the bus electrodes of the display electrodes is between adjacent discharge cells of every other row of the discharge cells, the bus electrodes of the scan electrodes being between adjacent discharge cells and between the bus electrodes of the display electrodes.

* * * * *

UNITED STATES PATENT AND TRADEMARK OFFICE

CERTIFICATE OF CORRECTION

PATENT NO. : 7,911,416 B2
APPLICATION NO. : 11/952075
DATED : March 22, 2011
INVENTOR(S) : Seok-Gyun Woo et al.

It is certified that error appears in the above-identified patent and that said Letters Patent is hereby corrected as shown below:

On the Title Page

| | |
|---|---|
| **(56) References Cited,** OTHER PUBLICATIONS, page 3, left column, line 69. | Delete "May 7, 2002"<br>Insert -- July 5, 2002 -- |
| **(56) References Cited,** OTHER PUBLICATIONS, page 3, right column, line 52. | Delete "Jan. 31, 2003in"<br>Insert -- Jan. 31, 2003 in -- |

Signed and Sealed this
Twenty-seventh Day of March, 2012

David J. Kappos

David J. Kappos
*Director of the United States Patent and Trademark Office*